US009233769B2

(12) United States Patent
Disrud et al.

(10) Patent No.: US 9,233,769 B2
(45) Date of Patent: Jan. 12, 2016

(54) SYSTEM AND METHOD FOR ACTIVATING ARTICLE PROTECTION FEATURES OF A CARTON

(71) Applicant: Graphic Packaging International, Inc., Atlanta, GA (US)

(72) Inventors: Jeff A. Disrud, Marietta, GA (US); Frank N. Moncrief, Acworth, GA (US); Kelly Ziegler, Crosby, MN (US)

(73) Assignee: Graphic Packaging International, Inc., Atlanta, GA (US)

( * ) Notice: Subject to any disclaimer, the term of this patent is extended or adjusted under 35 U.S.C. 154(b) by 0 days.

(21) Appl. No.: 14/621,798

(22) Filed: Feb. 13, 2015

(65) Prior Publication Data

US 2015/0158613 A1 Jun. 11, 2015

Related U.S. Application Data

(63) Continuation of application No. 13/655,527, filed on Oct. 19, 2012.

(60) Provisional application No. 61/548,779, filed on Oct. 19, 2011, provisional application No. 61/570,044, filed on Dec. 13, 2011.

(51) Int. Cl.
*B65B 61/24* (2006.01)
*B65B 21/02* (2006.01)
(Continued)

(52) U.S. Cl.
CPC ..... *B65B 21/08* (2013.01); *B65B 11/105* (2013.01); *B65B 21/02* (2013.01); *B65B 21/14* (2013.01);
(Continued)

(58) Field of Classification Search
CPC .... B65B 61/24; B65B 61/207; B65B 61/065; B65B 21/0002; B65B 11/105; B65B 7/20; B65B 35/54; B65B 2230/02; B65B 55/00; B65B 57/005; B65B 57/02; B65B 21/24; B65B 21/242; B65D 71/18; B65D 2571/00265; B65D 5/5028; B65D 11/105; B31B 1/74; B31B 1/78; B31B 1/80; B31B 1/90; B31B 1/92; B31B 11/00
USPC ..... 53/462, 398, 48.1, 48.6–48.9, 472, 53/139.5, 77, 361, 491, 128.1; 192/125 C, 192/125 R, 150, 116.5
See application file for complete search history.

(56) References Cited

U.S. PATENT DOCUMENTS 1,527,204 A 2/1925 McCormick
2,014,461 A 9/1935 Anton
(Continued)

FOREIGN PATENT DOCUMENTS

BE 672 492 A 3/1966
EP 0 024 782 A1 3/1981
(Continued)

OTHER PUBLICATIONS

Supplementary European Search Report for EP 12 78 2928 dated Mar. 11, 2015.
(Continued)

*Primary Examiner* — Gloria R Weeks
*Assistant Examiner* — Justin Citrin
(74) *Attorney, Agent, or Firm* — Womble Carlye Sandridge & Rice, LLP

(57) ABSTRACT

A system and method for activating a series of article protection features formed in product cartons in which a series of articles have been packaged includes an actuating assembly mounted along a path of travel for the cartons. The actuating assembly will include a series of actuating elements that are selectively moved into engagement with the article protection features of the cartons. The article protection features are urged into the cartons, between the articles therein and into positions engaging and supporting the articles.

39 Claims, 20 Drawing Sheets

(51) Int. Cl.

| | |
|---|---|
| ***B65B 21/08*** | (2006.01) |
| ***B65B 11/10*** | (2006.01) |
| ***B65B 21/24*** | (2006.01) |
| ***B65B 61/20*** | (2006.01) |
| ***B65D 71/18*** | (2006.01) |
| ***B65B 43/10*** | (2006.01) |
| ***B65B 55/00*** | (2006.01) |
| ***B65B 21/14*** | (2006.01) |
| ***B65D 71/00*** | (2006.01) |

(52) U.S. Cl.

CPC ..... *B65B 21/242* (2013.01); *B65B 43/10* (2013.01); *B65B 55/00* (2013.01); *B65B 61/207* (2013.01); *B65B 61/24* (2013.01); *B65D 71/00* (2013.01); *B65D 71/18* (2013.01); *B65D 2571/0045* (2013.01); *B65D 2571/0066* (2013.01); *B65D 2571/00141* (2013.01); *B65D 2571/00265* (2013.01)

(56) References Cited

U.S. PATENT DOCUMENTS

| | | | | |
|---|---|---|---|---|
| 2,331,137 | A | | 10/1943 | Rous |
| 2,877,894 | A | | 3/1959 | Forrer |
| 2,899,051 | A | | 8/1959 | Barnby |
| 2,926,782 | A | | 3/1960 | Andre |
| 2,933,867 | A | | 4/1960 | Gentry |
| 2,974,454 | A | | 3/1961 | Andre et al. |
| 3,013,796 | A | | 12/1961 | Currie, Jr. et al. |
| 3,015,923 | A | | 1/1962 | Dotzenroth |
| 3,016,663 | A | | 1/1962 | Holmes et al. |
| 3,032,945 | A | | 5/1962 | Currie, Jr. et al. |
| 3,034,270 | A | | 5/1962 | Nigrelli et al. |
| 3,045,401 | A | | 7/1962 | Ganz |
| 3,108,414 | A | | 10/1963 | Schleicher et al. |
| 3,128,034 | A | | 4/1964 | Weiss |
| 3,142,378 | A | | 7/1964 | Lengsfield, Jr. |
| 3,152,688 | A | | 10/1964 | Mahon |
| 3,166,879 | A | | 1/1965 | Chidsey, Jr. et al. |
| 3,167,214 | A | | 1/1965 | Mahon |
| 3,176,902 | A | | 4/1965 | Champlin |
| 3,186,136 | A | | 6/1965 | Ganz |
| 3,190,193 | A | | 6/1965 | Randles, Jr. |
| 3,196,588 | A | | 7/1965 | Chidsey, Jr. |
| 3,197,937 | A | | 8/1965 | Ganz |
| 3,203,153 | A | | 8/1965 | Wood |
| 3,206,097 | A | | 9/1965 | Holmes |
| 3,229,892 | A | | 1/1966 | Weiss |
| 3,252,649 | A | | 5/1966 | Graser et al. |
| 3,253,381 | A | * | 5/1966 | Wood ..... 53/398 |
| 3,255,919 | A | | 6/1966 | Koolnis |
| 3,300,947 | A | * | 1/1967 | Fahrenbach ..... 53/48.1 |
| 3,332,199 | A | | 7/1967 | Wong |
| 3,337,043 | A | | 8/1967 | Parker |
| 3,355,012 | A | | 11/1967 | Weiss |
| 3,367,557 | A | | 2/1968 | Farquhar |
| 3,386,570 | A | | 6/1968 | Lock |
| 3,387,428 | A | | 6/1968 | Currie, Jr. |
| 3,415,033 | A | | 12/1968 | Perry et al. |
| 3,432,029 | A | | 3/1969 | Brown |
| 3,474,590 | A | | 10/1969 | Ganz |
| 3,517,876 | A | | 6/1970 | Stout |
| 3,543,473 | A | | 12/1970 | Cato |
| 3,543,474 | A | * | 12/1970 | Hasselo ..... B65B 11/004 53/209 |
| 3,572,003 | A | | 3/1971 | Perry et al. |
| 3,627,193 | A | | 12/1971 | Helms |
| 3,669,342 | A | | 6/1972 | Funkhouser |
| 3,670,950 | A | | 6/1972 | Rossi |
| 3,679,121 | A | | 7/1972 | Morgese |
| 3,687,282 | A | | 8/1972 | Owen |
| 3,701,231 | A | | 10/1972 | Standley |
| 3,715,029 | A | | 2/1973 | Wood |
| 3,747,801 | A | | 7/1973 | Graser |
| 3,760,555 | A | | 9/1973 | Calvert |
| 3,767,042 | A | | 10/1973 | Ganz |
| 3,797,729 | A | | 3/1974 | Holmes |
| 3,815,320 | A | | 6/1974 | Ganz |
| 3,897,872 | A | | 8/1975 | Graser |
| 3,921,895 | A | | 11/1975 | Ziche |
| 3,923,235 | A | | 12/1975 | Roccaforte |
| 3,940,907 | A | | 3/1976 | Ganz |
| 3,942,631 | A | | 3/1976 | Sutherland et al. |
| 3,952,633 | A | | 4/1976 | Nakai |
| 3,963,121 | A | | 6/1976 | Kipp |
| 3,977,518 | A | | 8/1976 | Arneson |
| 3,986,319 | A | | 10/1976 | Puskarz |
| 4,012,887 | A | | 3/1977 | Calvert et al. |
| 4,034,852 | A | | 7/1977 | Forrer |
| 4,056,223 | A | | 11/1977 | Williams |
| 4,093,068 | A | | 6/1978 | Smrt |
| 4,093,116 | A | | 6/1978 | Watkins et al. |
| 4,095,693 | A | | 6/1978 | Killy |
| 4,095,735 | A | | 6/1978 | Stone |
| 4,101,069 | A | | 7/1978 | Wood |
| 4,131,230 | A | | 12/1978 | Koehlinger et al. |
| 4,146,168 | A | | 3/1979 | Hartline |
| 4,184,626 | A | | 1/1980 | Graser |
| 4,186,867 | A | | 2/1980 | Wood |
| 4,202,446 | A | | 5/1980 | Sutherland |
| 4,219,147 | A | | 8/1980 | Kohler |
| 4,256,226 | A | | 3/1981 | Stone |
| 4,274,187 | A | | 6/1981 | Painter et al. |
| 4,285,185 | A | | 8/1981 | Collura et al. |
| 4,295,562 | A | | 10/1981 | Wood |
| 4,324,328 | A | | 4/1982 | Champlin |
| 4,328,891 | A | | 5/1982 | Elward |
| 4,330,079 | A | | 5/1982 | Wood |
| 4,338,760 | A | | 7/1982 | Kuhn |
| 4,394,903 | A | | 7/1983 | Bakx |
| 4,396,118 | A | | 8/1983 | Watson |
| 4,398,631 | A | | 8/1983 | Graser |
| 4,421,232 | A | | 12/1983 | Konaka |
| 4,424,901 | A | | 1/1984 | Lanier |
| 4,437,569 | A | | 3/1984 | Sorenson |
| 4,437,606 | A | | 3/1984 | Graser |
| 4,438,843 | A | | 3/1984 | Graser |
| 4,463,852 | A | | 8/1984 | Stone |
| 4,465,180 | A | | 8/1984 | Klygis |
| 4,470,503 | A | | 9/1984 | Stone |
| 4,498,581 | A | | 2/1985 | Dutcher |
| 4,498,618 | A | | 2/1985 | Sutherland |
| 4,505,696 | A | | 3/1985 | Wright et al. |
| 4,512,135 | A | | 4/1985 | Scott et al. |
| 4,512,755 | A | | 4/1985 | Stone |
| 4,533,047 | A | | 8/1985 | Calvert |
| 4,545,485 | A | | 10/1985 | Oliff |
| 4,571,923 | A | | 2/1986 | Le Bras |
| 4,574,997 | A | | 3/1986 | Ikeda |
| 4,597,523 | A | | 7/1986 | Schuster |
| 4,600,140 | A | | 7/1986 | Milliens |
| 4,612,753 | A | | 9/1986 | Taylor et al. |
| 4,708,284 | A | | 11/1987 | Sutherland et al. |
| 4,723,699 | A | | 2/1988 | Brown et al. |
| 4,773,533 | A | | 9/1988 | Greene |
| 4,883,168 | A | | 11/1989 | Dreyfus |
| 4,890,737 | A | | 1/1990 | Kadleck et al. |
| 4,890,738 | A | | 1/1990 | Caver |
| 4,919,266 | A | | 4/1990 | McIntosh, Jr. et al. |
| 4,925,019 | A | | 5/1990 | Ganz et al. |
| 5,002,186 | A | | 3/1991 | Cooper |
| 5,002,225 | A | | 3/1991 | Bienaime |
| D316,672 | S | | 5/1991 | Wood |
| 5,020,668 | A | | 6/1991 | Schuster |
| 5,022,525 | A | | 6/1991 | Schuster |
| 5,031,770 | A | | 7/1991 | Chaussadas |
| 5,044,503 | A | | 9/1991 | Wein |
| 5,080,280 | A | | 1/1992 | Kraus |
| 5,094,347 | A | | 3/1992 | Schuster |
| 5,107,986 | A | | 4/1992 | Cooper |
| 5,131,588 | A | | 7/1992 | Oliff |
| 5,140,803 | A | | 8/1992 | Biggs et al. |
| 5,145,067 | A | | 9/1992 | Carver |

(56) References Cited

U.S. PATENT DOCUMENTS

| | | | | |
|---|---|---|---|---|
| 5,158,177 | A | | 10/1992 | Negelen et al. |
| 5,167,325 | A | | 12/1992 | Sykora |
| 5,246,112 | A | | 9/1993 | Stout et al. |
| 5,297,673 | A | | 3/1994 | Sutherland |
| 5,310,050 | A | | 5/1994 | Sutherland |
| 5,311,984 | A | | 5/1994 | Harris |
| 5,328,080 | A | | 7/1994 | Holley, Jr. |
| 5,360,104 | A | | 11/1994 | Sutherland |
| 5,360,113 | A | | 11/1994 | Harris |
| 5,385,234 | A | | 1/1995 | Stout et al. |
| 5,390,784 | A | | 2/1995 | Sutherland |
| 5,390,848 | A | | 2/1995 | Gungner et al. |
| 5,402,889 | A | | 4/1995 | Hermann et al. |
| 5,437,363 | A | | 8/1995 | Gungner |
| 5,439,112 | A | | 8/1995 | De Guglielmo et al. |
| 5,443,203 | A | | 8/1995 | Sutherland |
| 5,472,090 | A | | 12/1995 | Sutherland |
| 5,476,217 | A | | 12/1995 | Moncrief et al. |
| 5,484,059 | A | | 1/1996 | Sutherland |
| 5,485,915 | A | | 1/1996 | Harris |
| 5,509,549 | A | | 4/1996 | Marandola |
| 5,520,283 | A | | 5/1996 | Sutherland |
| 5,524,756 | A | | 6/1996 | Sutherland |
| 5,549,197 | A | | 8/1996 | Sutherland |
| 5,577,365 | A | | 11/1996 | Reuteler |
| 5,579,904 | A | | 12/1996 | Holley, Jr. |
| 5,582,289 | A | | 12/1996 | Wright |
| 5,592,804 | A | | 1/1997 | Reuteler |
| 5,595,291 | A | | 1/1997 | Negelen |
| 5,595,292 | A | | 1/1997 | Bates |
| 5,595,299 | A | | 1/1997 | LeBras |
| 5,605,228 | A | | 2/1997 | Baxter |
| 5,620,094 | A | | 4/1997 | Naumann |
| 5,638,659 | A | | 6/1997 | Moncrief et al. |
| 5,638,956 | A | | 6/1997 | Sutherland |
| 5,653,340 | A | | 8/1997 | Daniel |
| 5,664,401 | A | | 9/1997 | Portrait et al. |
| 5,669,203 | A | | 9/1997 | Muller |
| 5,671,587 | A | | 9/1997 | Robinson |
| 5,671,845 | A | | 9/1997 | Harris |
| 5,699,957 | A | | 12/1997 | Blin et al. |
| 5,765,685 | A | | 6/1998 | Roosa |
| 5,775,572 | A | | 7/1998 | Oliff |
| 5,927,053 | A | * | 7/1999 | Donovan et al. ..... 53/543 |
| 5,941,389 | A | | 8/1999 | Gomes |
| 5,947,367 | A | | 9/1999 | Miller et al. |
| 5,975,286 | A | | 11/1999 | Oliff |
| 5,975,287 | A | | 11/1999 | Negelen |
| 5,979,645 | A | | 11/1999 | Holley, Jr. |
| 5,984,086 | A | | 11/1999 | Fousghee et al. |
| 6,044,627 | A | | 4/2000 | De Guglielmo |
| 6,149,002 | A | | 11/2000 | Tiramani et al. |
| 6,155,412 | A | | 12/2000 | LeBras et al. |
| 6,170,741 | B1 | | 1/2001 | Skolik et al. |
| 6,173,889 | B1 | | 1/2001 | Sutherland |
| 6,179,115 | B1 | | 1/2001 | De Guglielmo et al. |
| 6,186,931 | B1 | | 2/2001 | Calvert et al. |
| 6,189,687 | B1 | | 2/2001 | Bakx |
| 6,213,297 | B1 | | 4/2001 | Gale |
| 6,223,892 | B1 | | 5/2001 | Bakx |
| 6,241,083 | B1 | | 6/2001 | Harrelson |
| 6,247,585 | B1 | | 6/2001 | Holley, Jr. |
| 6,273,330 | B1 | | 8/2001 | Oliff et al. |
| 6,295,789 | B1 | | 10/2001 | Muller |
| 6,315,111 | B1 | | 11/2001 | Sutherland |
| 6,315,123 | B1 | | 11/2001 | Ikeda |
| 6,520,316 | B2 | | 2/2003 | De Guglielmo et al. |
| 6,527,102 | B2 | | 3/2003 | De Guglielmo et al. |
| 6,527,108 | B1 | | 3/2003 | Blin et al. |
| 6,536,656 | B2 | | 3/2003 | Auclair et al. |
| 6,615,984 | B2 | | 9/2003 | Saulas et al. |
| 6,662,933 | B2 | | 12/2003 | De Guglielmo et al. |
| 6,669,083 | B2 | | 12/2003 | Bates |
| 6,695,137 | B2 | | 2/2004 | Jones et al. |
| 6,877,600 | B2 | | 4/2005 | Sutherland |
| 6,896,130 | B2 | | 5/2005 | Theelen |
| 6,942,140 | B2 | | 9/2005 | Merzeau |
| 6,948,293 | B1 | | 9/2005 | Eckermann et al. |
| 6,983,874 | B2 | | 1/2006 | Bakx |
| 6,997,372 | B2 | | 2/2006 | Gasparowicz |
| 7,028,839 | B2 | | 4/2006 | Belloli et al. |
| 7,048,113 | B2 | | 5/2006 | Gomes |
| 7,055,671 | B2 | | 6/2006 | De Guglielmo et al. |
| 7,063,208 | B2 | | 6/2006 | Lebras |
| 7,070,045 | B2 | | 7/2006 | Theelen |
| 7,073,705 | B2 | | 7/2006 | Auclair et al. |
| 7,134,547 | B2 | | 11/2006 | Auclair |
| 7,175,020 | B2 | | 2/2007 | Sutherland et al. |
| 7,234,591 | B2 | | 6/2007 | LeBras et al. |
| 7,278,538 | B2 | | 10/2007 | Charguearaud |
| 7,374,038 | B2 | | 5/2008 | Smalley |
| 7,427,010 | B2 | | 9/2008 | Sutherland |
| 7,467,729 | B2 | | 12/2008 | Lown et al. |
| 7,699,215 | B2 | | 4/2010 | Spivey, Sr. |
| 7,703,666 | B2 | | 4/2010 | Hand et al. |
| 7,721,878 | B2 | | 5/2010 | Requena |
| 7,780,067 | B2 | | 8/2010 | Holley, Jr. |
| 7,913,844 | B2 | | 3/2011 | Spivey, Sr. |
| 8,056,709 | B2 | | 11/2011 | Sutherland |
| 8,061,587 | B2 | | 11/2011 | Blin |
| 8,070,052 | B2 | | 12/2011 | Spivey, Sr. |
| 8,079,471 | B2 | | 12/2011 | Tokarski et al. |
| 8,162,135 | B2 | | 4/2012 | Oliveira |
| 8,376,214 | B2 | | 2/2013 | Spivey et al. |
| 8,523,048 | B1 | | 9/2013 | Spiegelman |
| 8,978,889 | B2 | | 3/2015 | Fitzwater et al. |
| 2001/0017315 | A1 | | 8/2001 | Baroudi |
| 2004/0000494 | A1 | | 1/2004 | Sutherland |
| 2004/0164135 | A1 | | 8/2004 | Gong et al. |
| 2007/0056869 | A1 | | 3/2007 | Tokarski |
| 2007/0181658 | A1 | | 8/2007 | Sutherland |
| 2007/0215682 | A1 | | 9/2007 | Bates et al. |
| 2007/0277481 | A1 | | 12/2007 | LeBras |
| 2008/0203143 | A1 | | 8/2008 | Holley |
| 2008/0257942 | A1 | | 10/2008 | LeBras |
| 2009/0032425 | A1 | | 2/2009 | Perkinson |
| 2009/0065559 | A1 | | 3/2009 | Parkes |
| 2009/0101526 | A1 | | 4/2009 | Sutherland et al. |
| 2009/0236408 | A1 | | 9/2009 | Spivey, Sr. et al. |
| 2010/0108544 | A1 | | 5/2010 | Biundo |
| 2010/0140336 | A1 | | 6/2010 | Ho Fung |
| 2011/0011924 | A1 | | 1/2011 | Spivey, Sr. et al. |
| 2011/0065558 | A1 | | 3/2011 | Smalley |
| 2011/0233091 | A1 | | 9/2011 | Block et al. |
| 2011/0284622 | A1 | | 11/2011 | Boukredine |
| 2011/0290867 | A1 | | 12/2011 | Schemmel et al. |
| 2012/0279897 | A1 | | 11/2012 | Schmal et al. |
| 2013/0097974 | A1 | | 4/2013 | Disrud et al. |
| 2013/0220873 | A1 | | 8/2013 | Holley, Jr. |
| 2014/0260095 | A1 | | 9/2014 | Oliveira |
| 2014/0305825 | A1 | | 10/2014 | Holley, Jr. |
| 2014/0305826 | A1 | | 10/2014 | Holley, Jr. |
| 2015/0001116 | A1 | | 1/2015 | Schmal et al. |

FOREIGN PATENT DOCUMENTS

| | | | |
|---|---|---|---|
| EP | 332 153 | B1 | 9/1991 |
| EP | 630 825 | A2 | 12/1994 |
| EP | 0 541 334 | B1 | 4/1995 |
| EP | 0 715 596 | B1 | 6/1995 |
| EP | 0 820 404 | B1 | 4/1996 |
| EP | 0 901 969 | B1 | 4/2000 |
| EP | 1 065 151 | A1 | 1/2001 |
| EP | 0 954 470 | B1 | 9/2002 |
| EP | 1 103 481 | B1 | 8/2004 |
| EP | 1 010 637 | B1 | 9/2004 |
| EP | 1 125 858 | B1 | 9/2004 |
| EP | 1 381 545 | B1 | 10/2005 |
| EP | 1 334 043 | B1 | 12/2005 |
| EP | 1 151 935 | B1 | 8/2006 |

(56) References Cited

FOREIGN PATENT DOCUMENTS

| | | | |
|---|---|---|---|
| EP | 1 513 737 | B1 | 11/2006 |
| EP | 2 055 648 | A1 | 5/2009 |
| EP | 1 749 755 | B1 | 12/2011 |
| FR | 2584677 | | 1/1987 |
| FR | 2619363 | A1 | 2/1989 |
| FR | 2684078 | A3 | 5/1993 |
| GB | 1 049 429 | A | 11/1966 |
| JP | 11-124129 | A | 5/1999 |
| JP | 3039805 | | 3/2000 |
| JP | 2008 213894 | A | 9/2008 |
| JP | 2009-120248 | | 6/2009 |
| KR | 20-2010-0010124 | | 10/2010 |
| WO | WO 92/09498 | | 6/1992 |
| WO | WO 93/14991 | A1 | 8/1993 |
| WO | WO 95/08489 | A1 | 3/1995 |
| WO | WO 2005/042370 | A1 | 5/2005 |
| WO | WO 2005/094471 | A2 | 10/2005 |
| WO | WO 2011/022145 | A1 | 2/2011 |
| WO | WO 2011/049947 | A1 | 4/2011 |

OTHER PUBLICATIONS

International Search Report and Written Opinion for PCT/US2013/030776 dated Jun. 27, 2013.
International Search Report and Written Opinion for PCT/US2012/029022 dated Sep. 26, 2012.
International Search Report and Written Opinion for PCT/US2013/031288 dated Jun. 13, 2013.
International Search Report and Written Opinion for PCT/US2014/037642 dated Sep. 5, 2014.
International Search Report and Written Opinion for PCT/US2014/033445 dated Sep. 5, 2014.
Supplementary Partial European Search Report for EP 12 78 2928 dated Nov. 28, 2014.
International Search Report and Written Opinion for PCT/US2012/060948 dated Mar. 28, 2013.
International Search Report and Written Opinion for PCT/US2013/031205 dated Nov. 26, 2013.
Supplementary European Search Report for EP 12 84 0937 dated Jun. 3, 2015.

* cited by examiner

SYSTEM AND METHOD FOR ACTIVATING ARTICLE PROTECTION FEATURES OF A CARTON

CROSS REFERENCE TO RELATED APPLICATIONS

This application is a continuation of U.S. patent application Ser. No. 13/655,527, filed Oct. 19, 2012, which claims the benefit of U.S. Provisional Application No. 61/548,779, filed Oct. 19, 2011, and U.S. Provisional Application No. 61/570,044, filed Dec. 13, 2011.

INCORPORATION BY REFERENCE

The entire contents of U.S. patent application Ser. No. 13/655,527, filed Oct. 19, 2012, U.S. Provisional Application No. 61/548,779, filed Oct. 19, 2011, and U.S. Provisional Application No. 61/570,044, filed Dec. 13, 2011 are hereby incorporated by reference as if presented herein in their entirety.

FIELD OF THE INVENTION

The present invention relates generally to systems and methods for packaging articles, and in particular relates to a system and method for engaging protective features of a carton containing fragile articles to provide protection for such fragile articles.

BACKGROUND OF THE INVENTION

Breakage of fragile articles such as glass beverage bottles or other, similar easily broken or damaged containers during shipping and handling of the cartons with the fragile bottles contained therein has long been a significant problem for bottlers and other manufacturers, resulting in losses both in terms of damaged or destroyed products as well as returned products. In the past, to guard against such breakage, bottles and/or other types of fragile articles generally have been packaged and shipped or transported in thick, heavyweight cardboard or plastic cartons or shipping containers. For example, beverage bottles are often sold in groups of twelve, eighteen or twenty-four bottles within large, heavyweight cardboard or paperboard cases, with the bottles being individually sectioned to avoid contact therebetween. While providing significant protection for the bottles from contact with each other and breakage, such heavyweight paperboard cases or cartons typically are very expensive. Alternatively, thinner paperboard cartons such as for containing twelve packs of bottles also have been introduced and sold. While less expensive, such cartons, however, provide reduced protection against breakage of the bottles.

Accordingly, it can be seen that a need exists for cartons or containers having protection features to protect breakable articles stored therein and a system and method for activating such article protection features that addresses the foregoing and other related and unrelated problems in the art.

SUMMARY OF THE INVENTION

Briefly described, the present invention generally comprises a system and method for the actuation or activation of article protection features within cartons into engagement with the articles stored within a carton. This system has particular applicability for use in the protection of fragile articles such as glass bottles or other, similar articles that can be prone to shifting or moving within their cartons or other containers, without the need for additional dividers or other elements to be placed within the cartons and/or without the cartons being formed with defined compartments for loading individual bottles or other fragile articles. The system and method for activating the article protection features of a carton can be a separate system or assembly that can be located apart from a packaging machine, receiving filled cartons therein for activating their article protection features, both as an automatically operable system and a manually operable system. Alternatively, the system can be integrated into an existing product packaging machine, being removably mounted along the path of travel of the cartons, downstream from the area of the packaging machine where the cartons are loaded with the articles for activating the article protection features thereof.

In addition, the system will include an actuating assembly having a plurality of actuating elements or members moving between a first, non-engaging or non-operative position and a second, operative or engaging position for engaging and activating the article protection features of the cartons passing thereby. The actuating assemblies of the various embodiments further can be formed as a change-part system or with replaceable components to enable the removal and replacement thereof to adapt or change the actuating assembly as needed for the activation of article protection features of different sizes and/or configuration cartons, which can include one, two or more rows of article protection features arranged in varying orientations and spaced configurations within the cartons.

In one embodiment, the system of the present invention can include an inlet conveyor on which the cartons are received and are conveyed toward the actuating assembly of the system. The actuating assembly can include a conveying mechanism along which a series of sleds or carriers are mounted and are conveyed about a substantially elliptical path of travel. Each of the sleds generally will include a body having guides or brackets along side edges thereof for engaging and mounting the sleds to the conveying mechanism, and a substantially flat upper surface on which the cartons are received. A series of openings generally will be formed in the upper surface of each sled, which openings generally will be substantially aligned with the locations of the article protection features of cartons loaded thereon. Actuating elements such as punches, fingers, lugs or other, similar actuating members are moveable through the openings formed in the upper surface of each sled for engaging and activating the article protection features of the cartons. The sleds are moved along a cam track array or section, which includes a series of cam tracks engaged by cam rollers linked to each of the actuating elements. As the cam rollers of the actuating elements move along their respective cam tracks, the actuating elements are selectively moved into and out of engagement with their aligned or associated article protection features of the carton loaded thereon. As a result, the article protection features are urged into the interior of the cartons, generally being moved into positions between and/or engaging portions of the articles within the cartons to stabilize and support the articles.

In an alternative embodiment, the system can include an actuating assembly that can include a cassette or series of cassettes or similar mechanisms that can be removably mounted to the frame of the packaging machine. The cassette(s) can be formed as change parts that can be removed and/or exchanged as needed to accommodate varying size configuration cartons and/or varying configurations and spacings of article protected features therein. Each of the cassettes can include a series of actuating elements such as punches, fingers, lugs or other actuating members that are moved by a conveying mechanism about the body of their cassette, and which engage and roll along a cam track so as to cause the actuating lugs to be moved between raised and lowered positions for engaging and actuating the article protection features of the cartons as the cartons pass thereover.

In another embodiment of the system and method for activating article protection features of a carton according to the principles of the present invention, the system can include an actuating assembly mounted downstream from the loading area of the packaging machine. The actuating assembly can comprise a series of star wheels, each having a plurality of articulating elements, such as punches, lugs, fingers, or other, similar actuating members mounted in spaced series about the periphery thereof. The star wheels further can include one or more cam-operated wheels including a rotating carrier to which the actuating elements are pivotally attached, and a cam wheel positioned adjacent the rotating carrier. As the rotating carrier moves the actuating elements about a rotary path, cams attached to the actuating elements move along a cam track formed in the cam wheel, causing the actuating elements to be pivoted or moved between engaging and non-engaging positions for engaging carton passing thereover. The remaining star wheels can include one or more fixed or stationary element wheels in which the actuating elements or members are substantially fixed in place at desired positions about the periphery of the bodies of their star wheels. The actuating assembly can include at least one, and typically two to three rotating star wheels, although more star wheels can be provided as needed, each mounted on a drive shaft with a releasable coupling and generally being driven in timed relationship to each other and to the movement of the cartons along a dead plate or guide positioned thereover.

As the cartons are received in the area of the present system for activating the article protection features of the cartons, the cartons will be engaged by a pair of side belts, which tend to center and orient the cartons with their article protection features generally aligned with spaced slots in the dead plate through which the actuating elements of the star wheels will project for engaging and activating the article protection features. The side belts generally are biased inwardly so as to maintain the lateral position of the cartons as needed, while still enabling some shifting or lateral movement of the bottles or other articles within the cartons as the article protection features thereof are engaged and extended into the cartons. An over-travel protection system further is provided, generally including a series of cylinders or similar elements mounted to brackets that support the star wheels. Upon engagement of a bottle or element other than an article protection feature, which resists the insertion of the actuating elements into the cartons and/or applies a back-pressure thereagainst, the over-travel protection cylinders will enable the star wheels to move or be otherwise lowered out of engagement with the carton so as to prevent damage to the articles therein. At the same time, a signal can be sent to alert an operator of a problem condition encountered by the star wheels which activated the over-travel protection system, and/or the operation of the packaging machine can be automatically halted to correct such a problem.

Further alternative embodiments of actuating assemblies for use in the system and method of actuating article protection features of a carton according to the principles of the present invention can include an elongated cylinder having an internal cam track over which a series of cam rollers attached to a series of actuating elements move for pivoting or moving the actuating elements between engaging and non-engaging positions. Still further, various combinations of star wheels and/or moveable punch assemblies also can be used for selectively engaging the article protection features of the cartons as needed.

Various objects, features and advantages of the present invention will become apparent to those skilled in the art upon a review of the following detailed description, when taken in conjunction with the accompanying drawings.

BRIEF DESCRIPTION OF THE DRAWINGS

FIGS. 1A-1I illustrate various example cartons and carton blanks incorporating article protection features adapted to be actuated or engaged by operation of the system and method according to the principles of the present invention.

Various features, advantages and aspects of the present invention may be set forth or apparent from consideration of the following detailed description, when taken in conjunction with the accompanying drawings. Moreover, it will be understood that the accompanying drawings, which are included to provide a further understanding of the present disclosure, are incorporated in and constitute a part of this specification, illustrate various aspects, advantages and benefits of the present disclosure, and together with the detailed description, serve to explain the principles of the present disclosure. In addition, those skilled in the art will understand that, according to common practice, various features of the drawings discussed below are not necessarily drawn to scale, and that dimensions of various features and elements of the drawings may be expanded or reduced to more clearly illustrate the embodiments of the present disclosure.

DESCRIPTION OF THE INVENTION

Figure 1A:
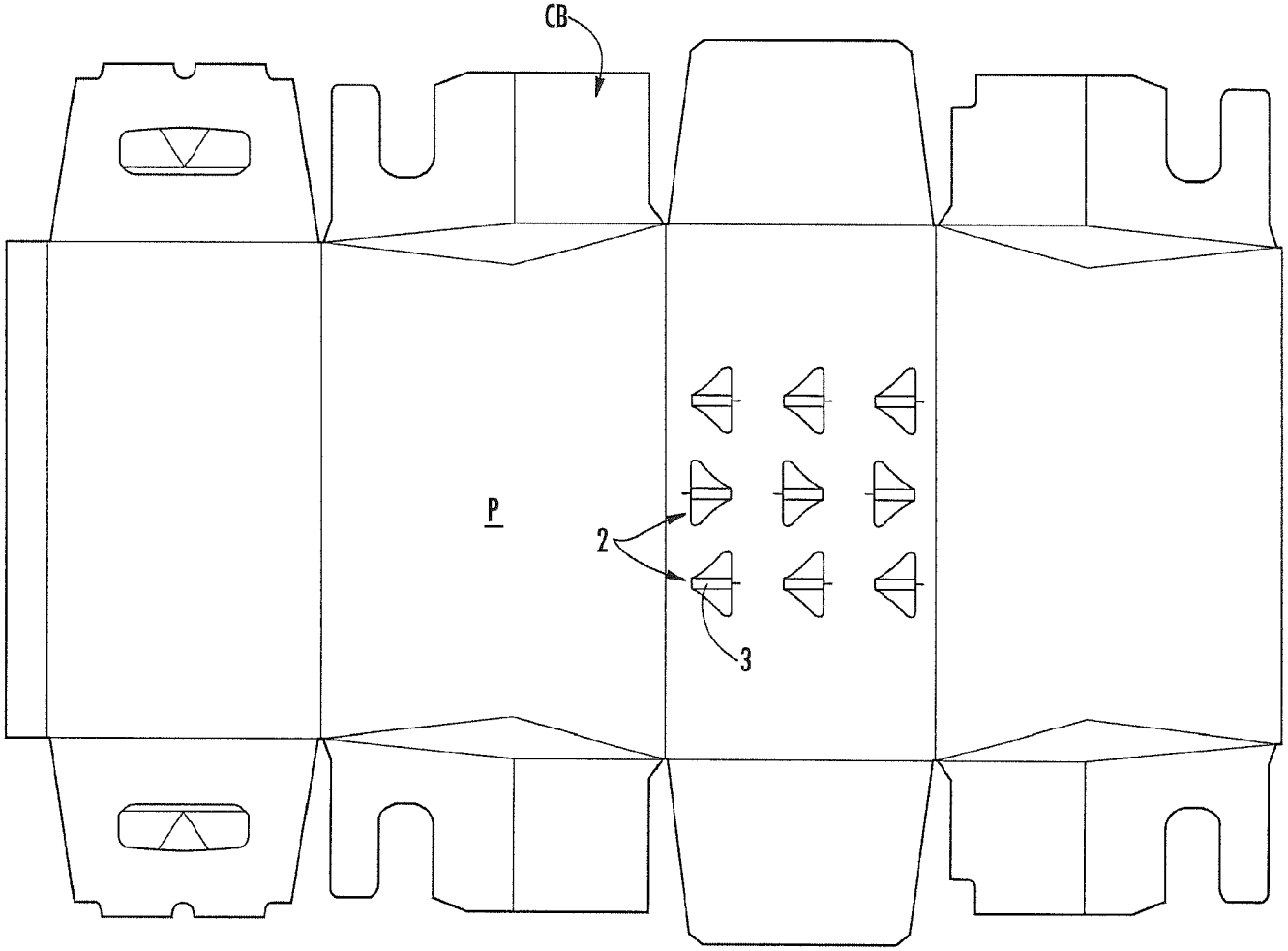
Figure 1B:
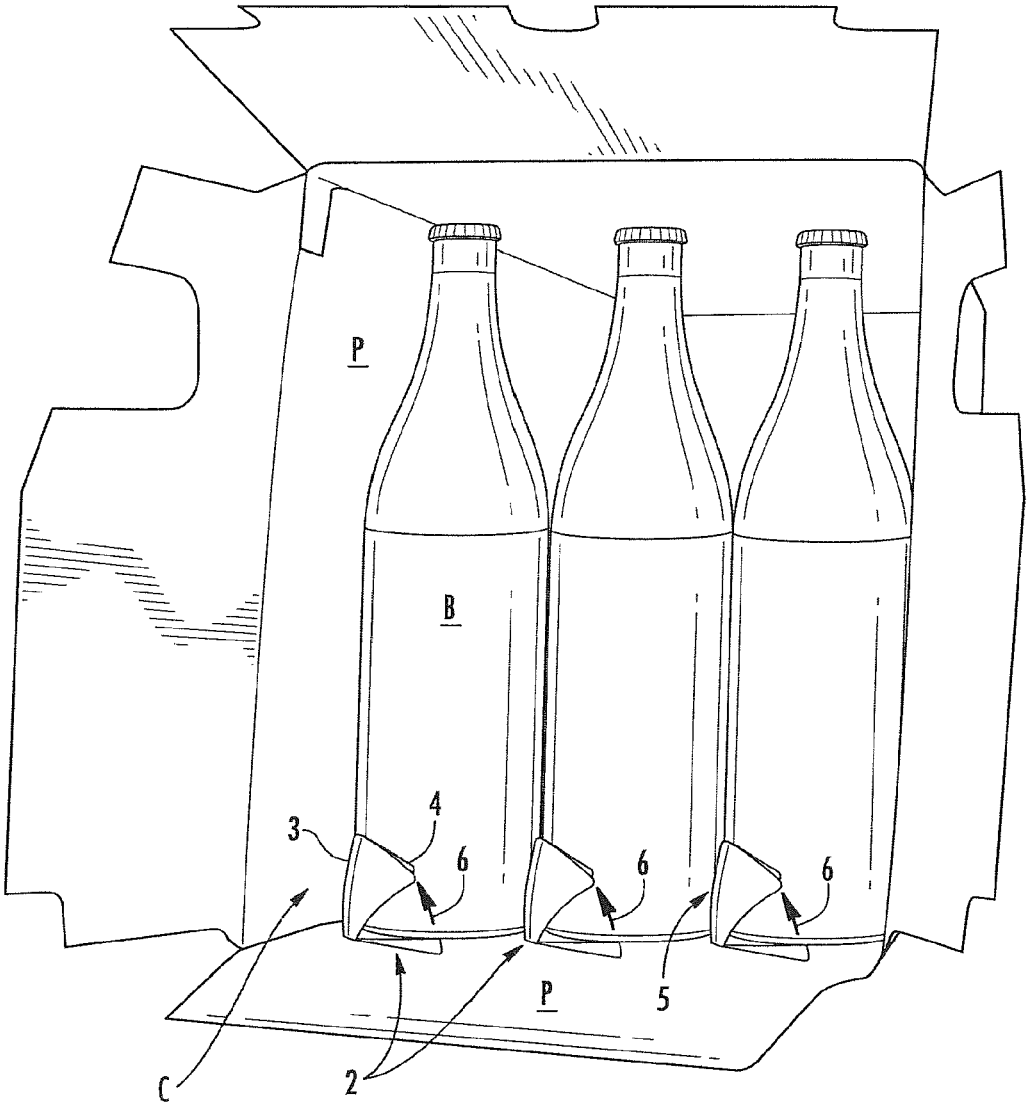
Figure 1C:
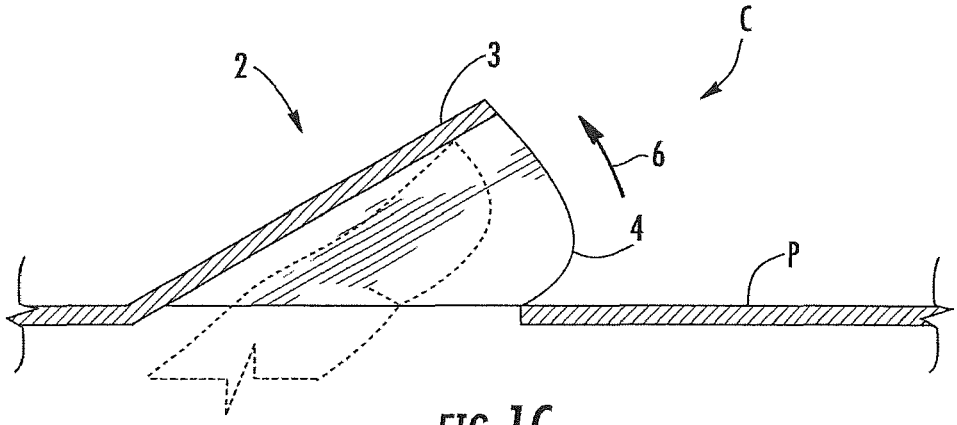
Figure 1D:
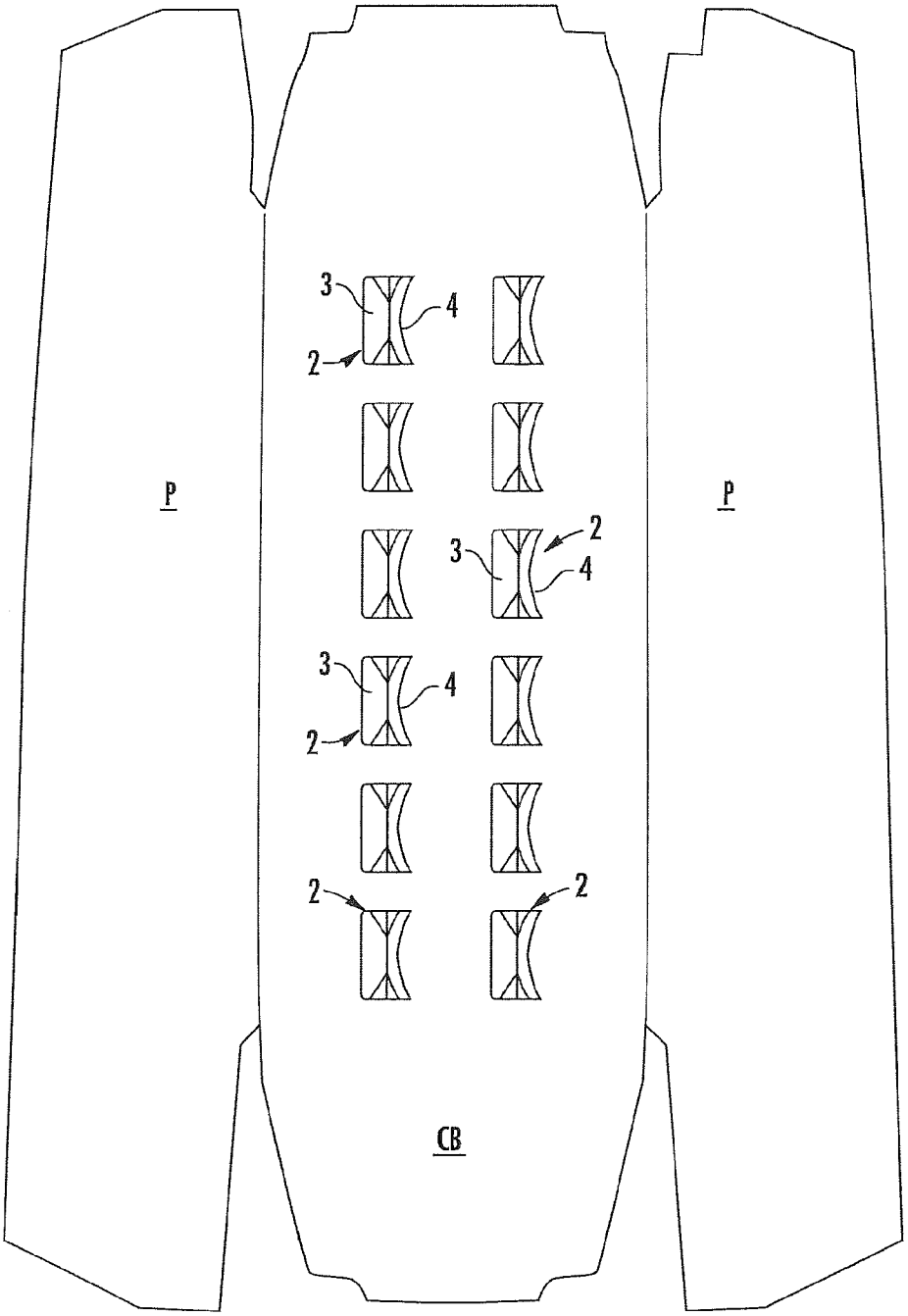
Figure 1E:
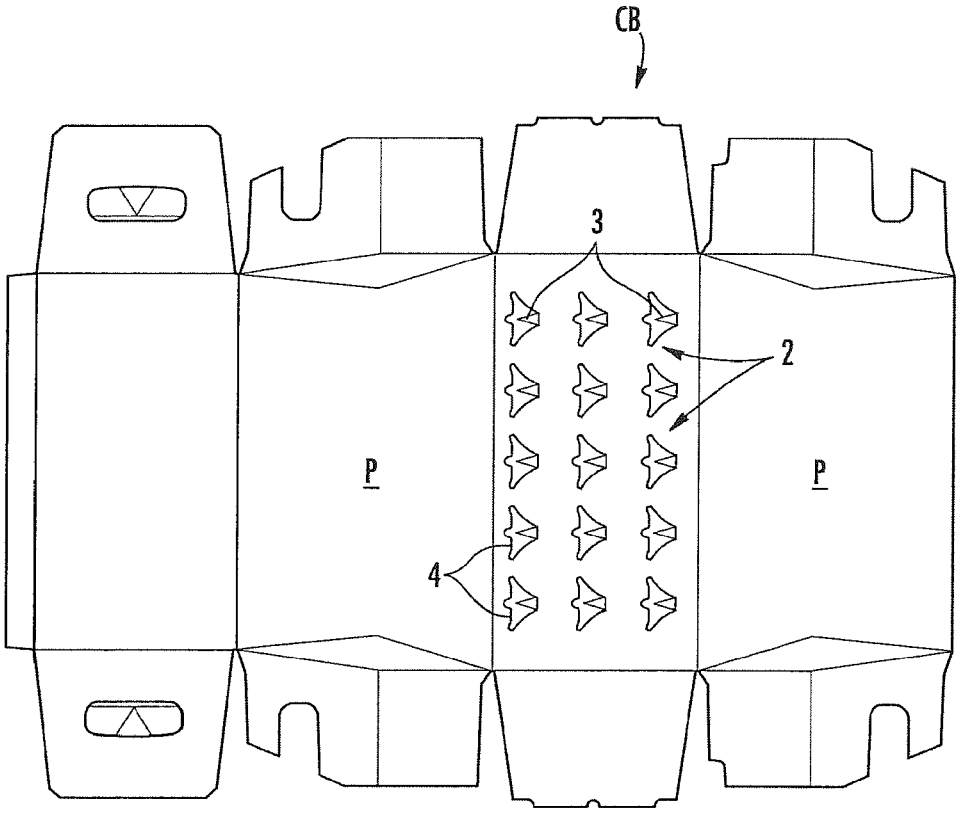
Figure 1F:
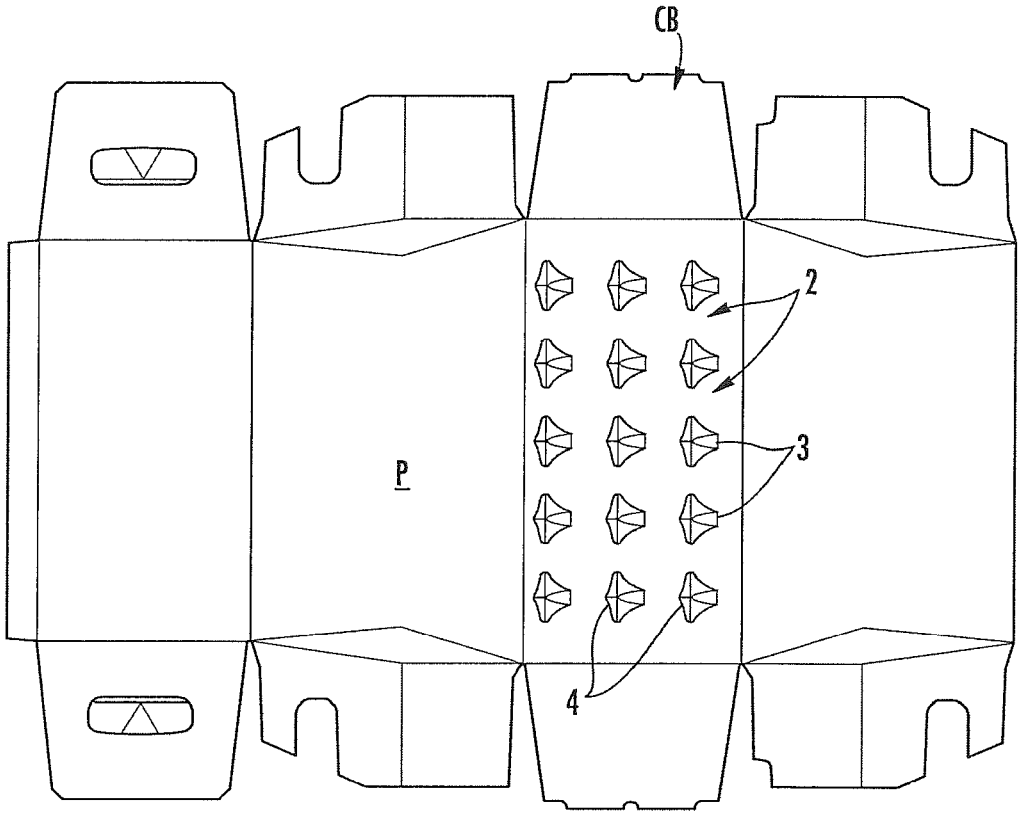
Figure 1G:
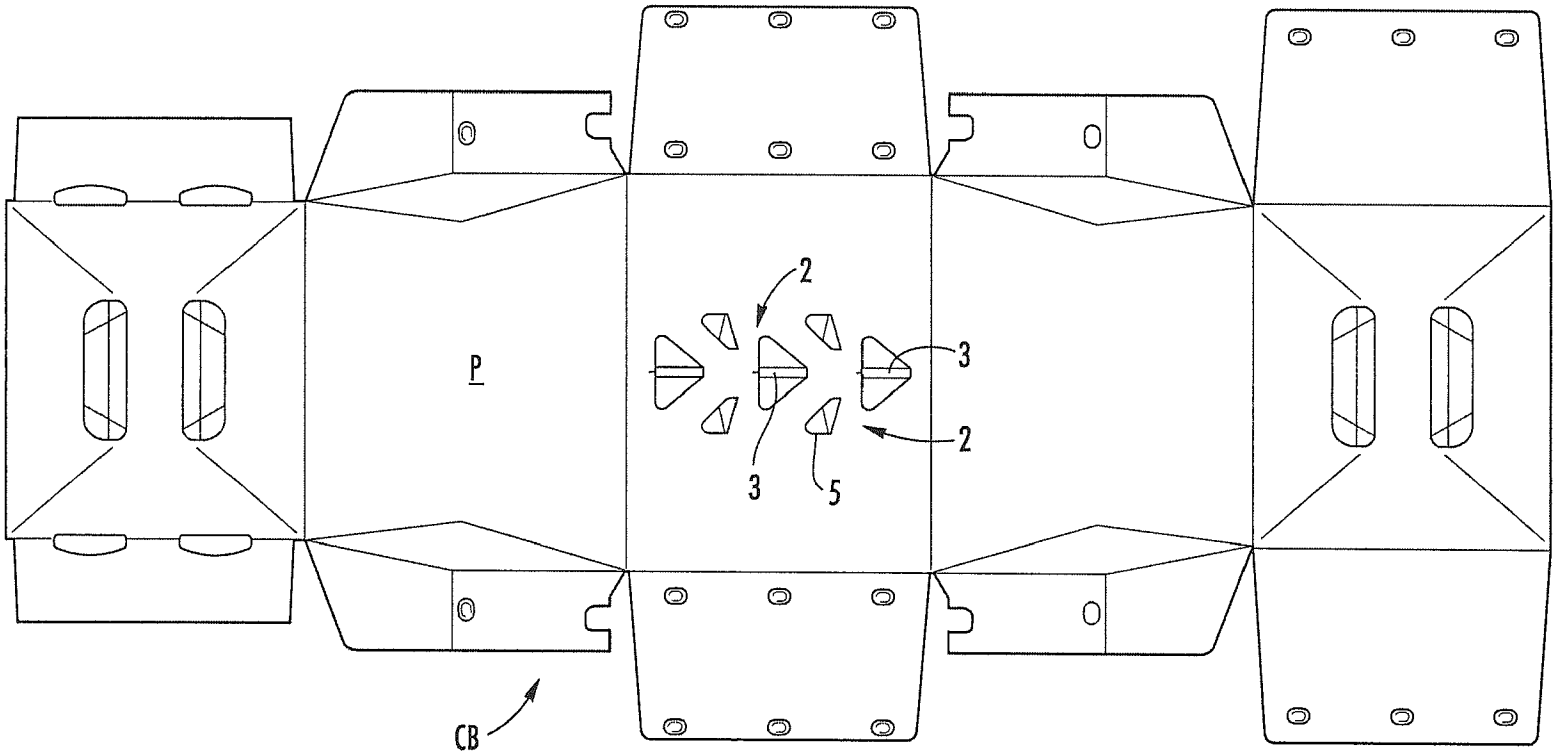
Figure 1H:
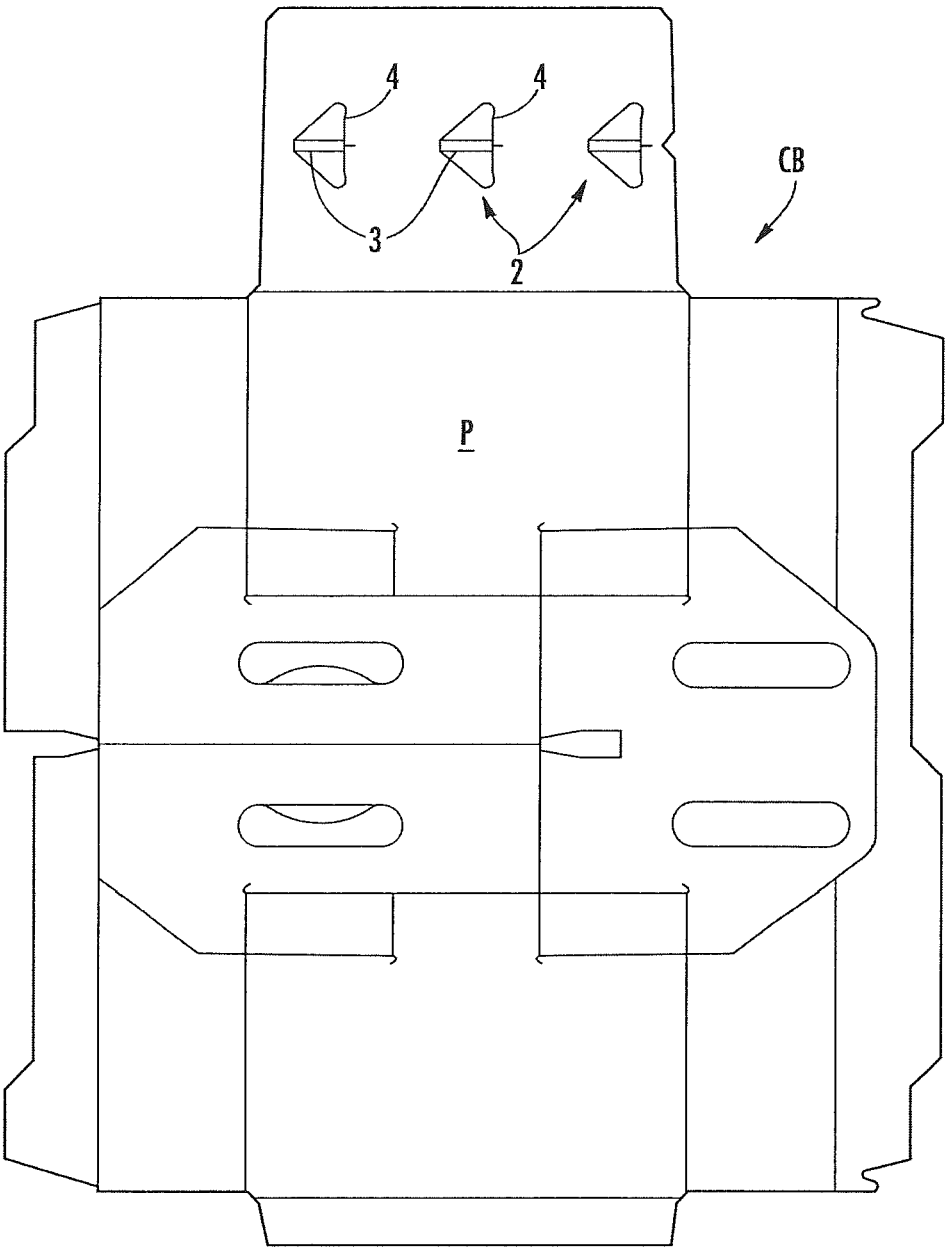
Figure 11:
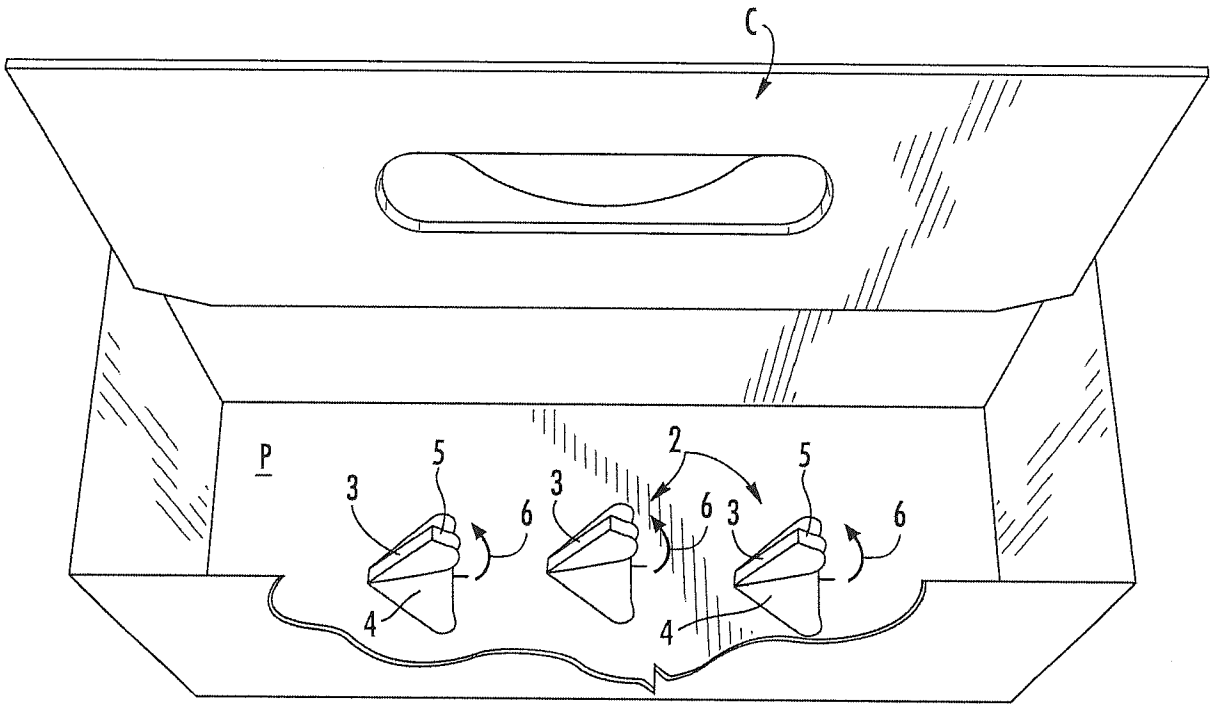

The present invention generally relates to a system and method for engaging or actuating article protection features 2 of various type, size and/or configuration carton blanks CB and cartons C. For example, FIGS. 1A-1I illustrate a series of carton blanks and/or cartons including various designs of carton protection features 2 including upstanding tabs or projections 3 defining seating recesses 4 (FIG. 1B) and/or stabilizing members 5 (FIG. 1I) formed in one or more panels P of the carbon blanks CB (FIGS. 1A, 1C-1H) or cartons C (FIGS. 1B, 1I), and adapted to be engaged and urged to an upward, locked position, as indicated by arrow 6 in FIG. 1C, generally being inserted between and/or engaging bottom/side portions of the articles as shown in FIG. 1B, so as to stabilize and hold breakable articles such as glass bottles B or other, similar articles in place within a carton to substantially reduce the amount of breakage experienced with such cartons. Further examples of cartons and/or carton blanks incorporating article protection features of a type adapted to be engaged and actuated by the systems and methods according to the principles of the present invention can be found in co-owned pending U.S. patent application Ser. No. 13/419,740, the disclosure of which is incorporated by reference as if set forth fully herein. The cartons themselves further can be wrap- or sleeve-style cartons generally formed from a paperboard material, which is wrapped about or loaded with a series of bottles or other breakable articles and sealed prior to engagement of the article protection features therein. FIGS. 2-9 illustrate various embodiments of systems and methodologies for packaging products within the cartons and engaging the article protection features to stabilize and retain the articles packaged therein.

Figure 2:
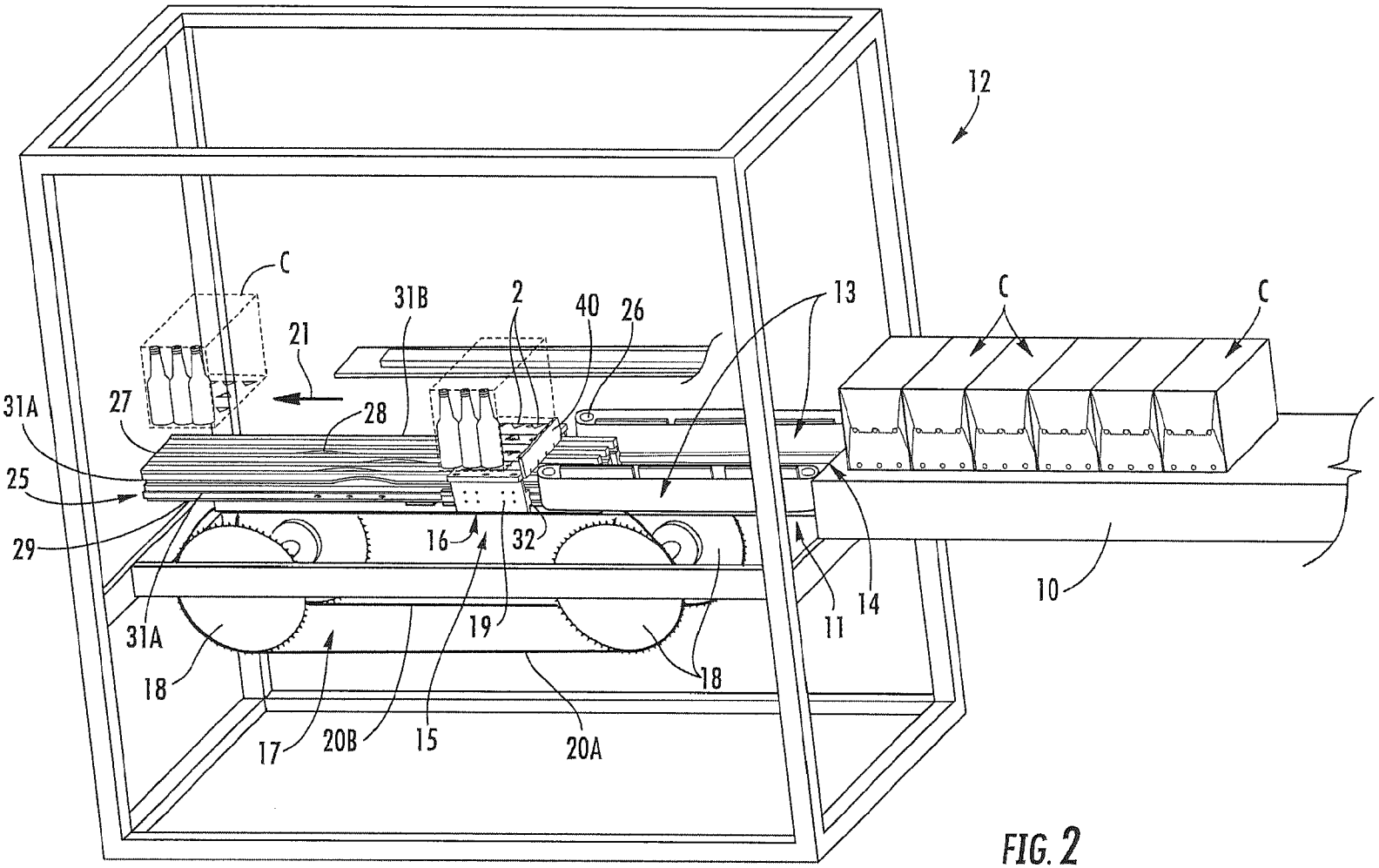
FIG. 2 is a perspective illustration of one example embodiment of a system for receiving filled cartons incorporating article protection features such as illustrated in FIGS. 1A-1I, and actuating or engaging the article protection features thereof.

As illustrated in FIG. 2, in one example embodiment of a system and method for actuating article protection features 2 of a carton C, the filled cartons C generally will be fed via an inlet conveyor 10 into a first or inlet end 11 of the system 12 for engaging and/or actuating the article protection features of the cartons. In this embodiment, the cartons are generally shown as being filled and their ends closed and sealed, though it should be understood by those skilled in the art that this system also could receive and engage the article protection features of the cartons after loading of the cartons but with the end flaps of the cartons in an unfolded, unsealed condition. The inlet conveyor 10 of the system 12 for engaging and/or actuating the article protection features of the cartons can be positioned in line with and receive the filled cartons directly from a packaging machine or an outlet or discharge conveyor for a packaging machine so as to operate as a final step in the product packaging operation as a part of the product packaging line. Alternatively, the system 12 can be provided as a separate, stand-alone system, with the cartons C being placed thereon by manual or automatic loading (not shown) for feeding into the system for engaging or actuating the article protection features of the cartons.

Figure 3:
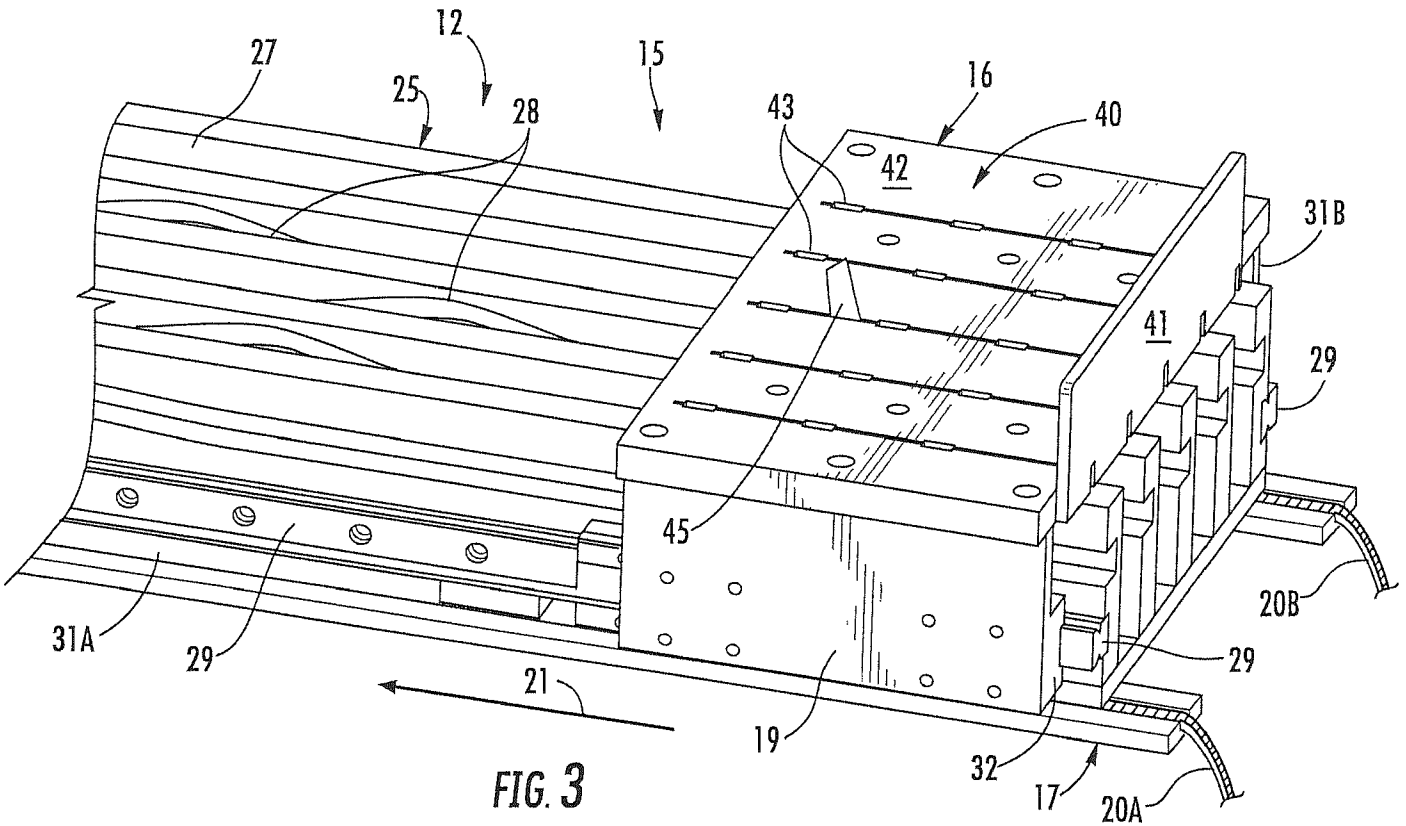
FIG. 3 is a perspective illustration of the sled and cam track assembly of the system of FIG. 2.
Figure 4:
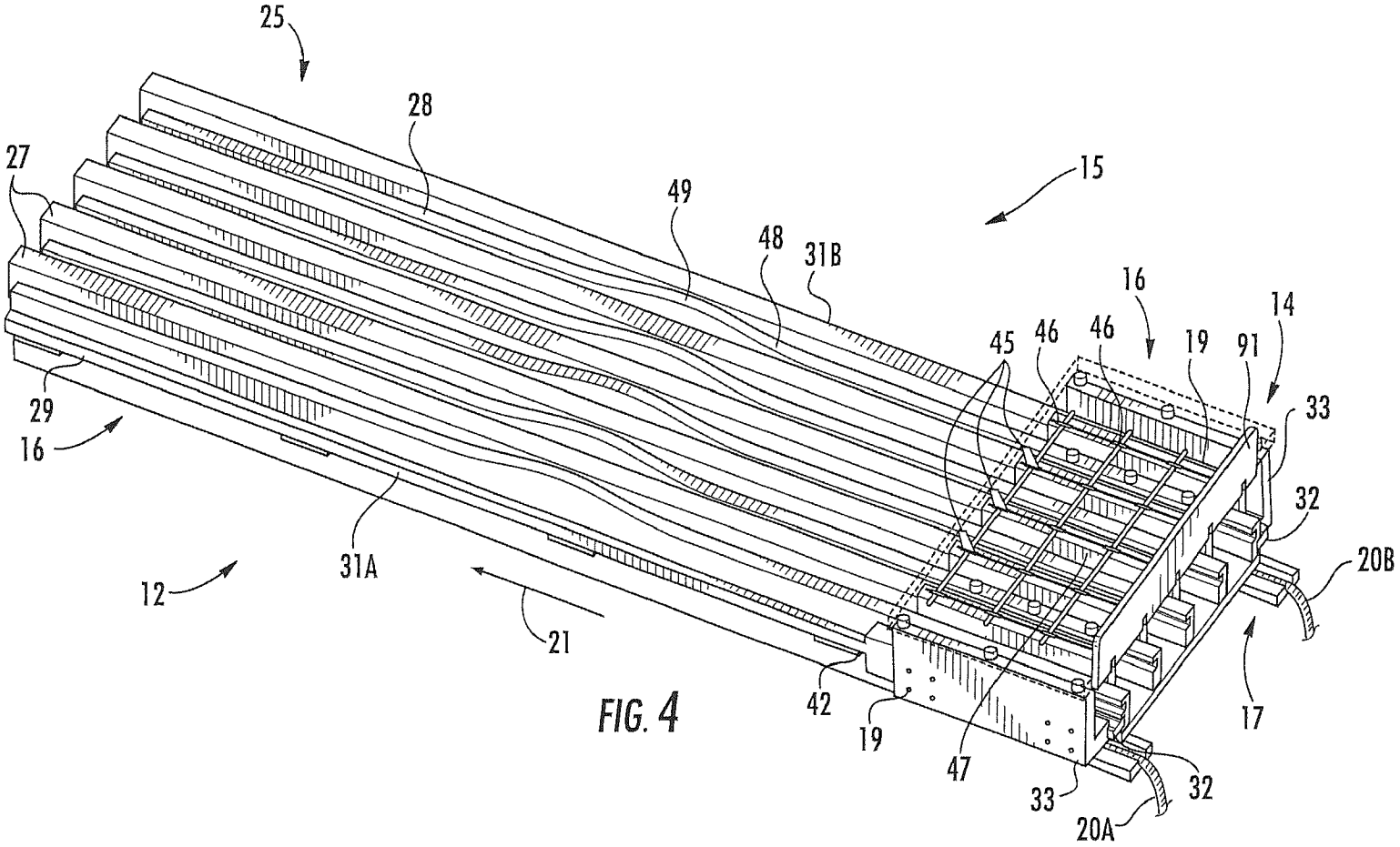
FIG. 4 is a perspective illustration, illustrating in further detail the cam tracks and internal camming systems for the actuating elements of the sled illustrated in FIGS. 2 and 3.

As FIG. 2 illustrates, the cartons are initially engaged by a pair of longitudinally extending side belts 13. The side belts 13 engage the cartons, centering the cartons as they enter the system 12, and will further assist in metering and controlling the back pressure of the cartons as the cartons are fed to a depositing position 14 passed to an actuating assembly 15 for activation of the article protection features of the carton. In this embodiment, the actuating assembly 15 generally can include at least one carrier or sled 16 on which the cartons will be deposited that is rotated upwardly and into a position for receiving the cartons by operation of a conveyor mechanism 17 (FIGS. 3 and 4). The conveyor mechanism 17 generally can include a pair of laterally spaced chains, conveyor belts 20A/20B or other similar mechanisms for driving the carriage that extend along a substantially elliptical path about drive sprockets 18 (FIG. 2) with a series of sleds 16 mounted therealong. For purposes of clarity, only one carrier or sled is being illustrated in the present disclosure. However, it will be understood by those skilled in the art that a series of sleds 16, each pitched at approximately a 12 to 15-inch spacing generally will be inserted at spaced locations along and will be conveyed by the conveyor mechanism. The spacing of the sleds and the number of sleds placed thereon further can be varied depending upon the speed at which the cartons are being fed into the system 11, the size of the cartons and/or length of the system conveyor mechanism as needed or desired to achieve a desired production rate.

Each of the sleds 16 of the actuating assembly 15 generally will be mounted on a pair of upstanding brackets 19 (FIG. 3) attached to the drive chains or belts 20A/20B of the conveyor mechanism 16 and will be drawn along a path of travel, indicated by arrow 21, by the operation of the drive chains or belts of the conveyor mechanism. A cam track array or section 25 generally is mounted along a portion of the path of travel 21 of the sled 16 on the conveyor mechanism 17, located downstream from the depositing portion 14 at which the cartons are deposited or received on top of the sled 16, and further typically will be positioned immediately adjacent from the distal ends 26 of the side belts 13. The cam track array 25 generally includes a series of spaced rails 27, with a series of cam tracks 28 mounted therebetween. Peripheral guide rails 29 typically are positioned on each side 31A/31B of the cam track array 25, which peripheral guide rails 29 generally will be engaged by C-shaped clamps, shoes or similar sliding connecting members 32 mounted along an inwardly facing side edge 33 of each of the sled brackets 19. The engagement of the clamps or shoes 32 of the sled brackets 19 with the peripheral guide rails 29 of the cam track array 25 will help stabilize and reduce unnecessary movement of the sleds as they are moved along the cam tracks 28 for engagement and actuation of the article protection features of the cartons received and being transported thereon.

As FIGS. 3 and 4 illustrate, each of the sleds 16 of the actuating assembly 15 generally can comprise a substantially rectangularly shaped body 40 having an upstanding rear wall 41 and an upper support plate 42 with a series of spaced slots 43 defined therein. As FIG. 4 illustrates, within each sled is a series of actuating fingers, punches or other elements 45 which are typically pivotally mounted to support rods 46 that extend laterally across the width of the sled 16. As a lower cam portion 47 of each of the actuating fingers 45 engages and moves along the respective valleys 48 and peaks or hills 49 of their associated cam tracks 28, the actuating fingers are urged upwardly or allowed to move downwardly through the slots 43 (FIG. 3) formed in the upper support plate 42 of their sled 25. The movement of the actuating fingers into an upward, engaging position is generally timed, based upon the number and location of article protection features for each carton of a desired size. As a result, fewer or less actuating fingers can be provided and/or the cam tracks can be adjusted or changed out and to provide for selective actuation of the actuating fingers as needed to avoid engagement of the cartons by the actuating fingers at locations where the cartons do not have article protection features and/or for engaging different size/configuration cartons.

As the sleds move their cartons along their path of travel 21 and along the cam track array 25 or section of the actuating assembly 15, the actuating fingers are moved or pivoted to their upward, engaging positions, engaging the article protection features of the cartons, at varying or different intervals in order to accommodate for some shifting or movement of the articles therein without damaging the articles. As a result, as the sleds/cartons reach the end of the cam track array, each of the article protection features of each carton contained on each sled should be activated so as to secure the breakable articles in a safe, guarded position within the cartons.

FIGS. 5A-9 illustrate additional embodiments of a system and method for activating article protection features of a carton according to the principles of the present invention. In the embodiments illustrated in FIGS. 5A-9, the systems for activating the article protection features of the cartons can be integrated into a packaging machine, along the path of travel of the cartons and upstream from the discharge end of the packaging machine, in addition to or as a substitute for providing a system for activating the article protection features of the cartons that functions as an add on or separate system linked to the discharge end of the packaging machine. In these embodiments, the systems can comprise actuating assemblies including modules or change-parts that can be easily mounted and dismounted within a packaging machine such as, for example, a Quikflex® article packaging machine in which a series of articles such as bottles, cans, or other similar products, are loaded into a series of cartons for packaging of the articles in groups such as six-packs, twelve-packs, etc. These systems further typically will be located downstream from a loading position or area at which the articles such as bottles or cans are loaded into the cartons. The embodiments illustrated in FIGS. 5A-9 further can be located along the path of travel of the cartons in a position before or after folding and closing of the ends of the cartons.

Figure 5A:
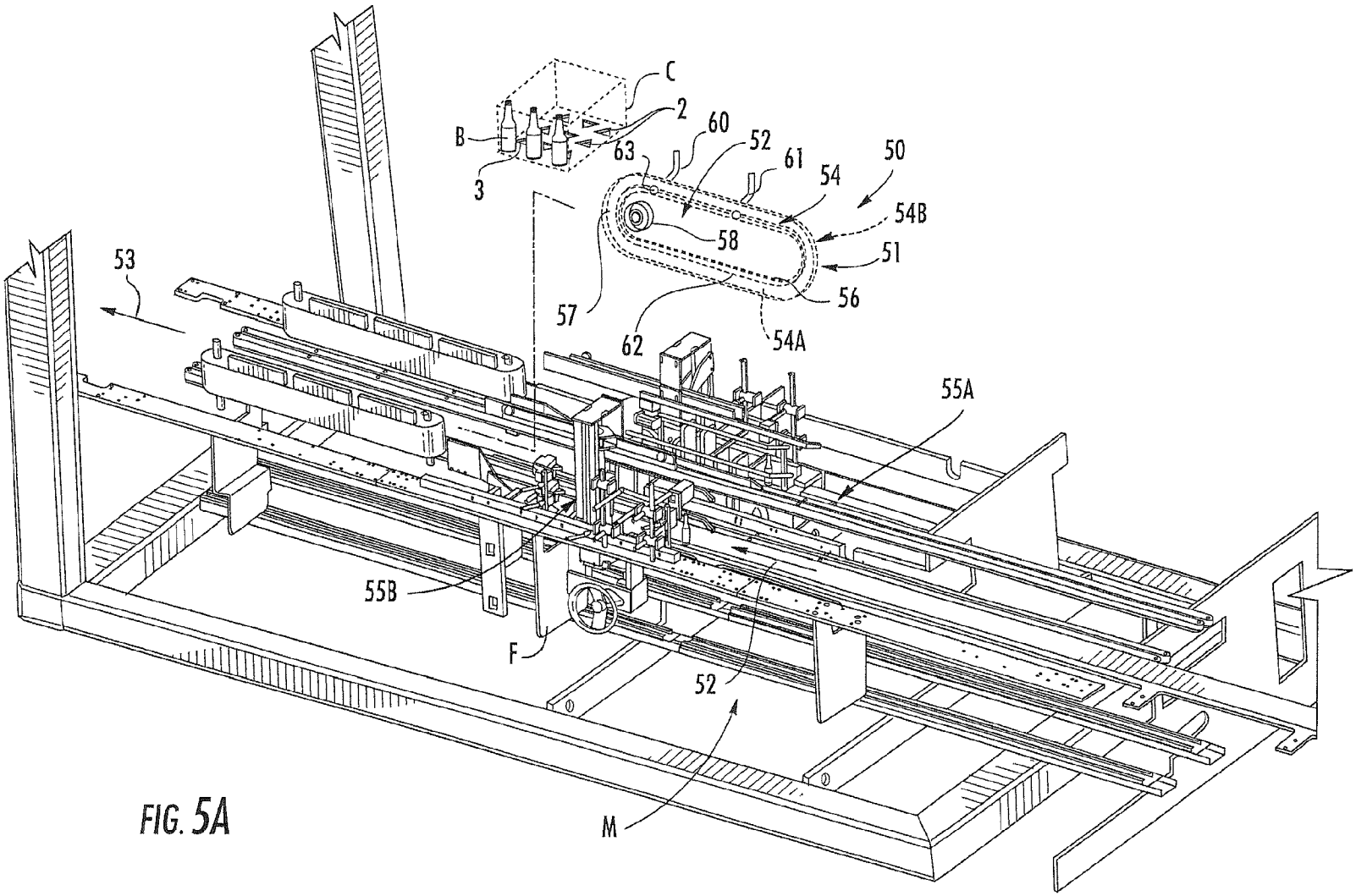
FIG. 5A is a perspective illustration of a portion of a packaging machine, schematically illustrating an additional embodiment of the system and method for activating article protection features of a carton according to the principles of the present invention.
Figure 5B:
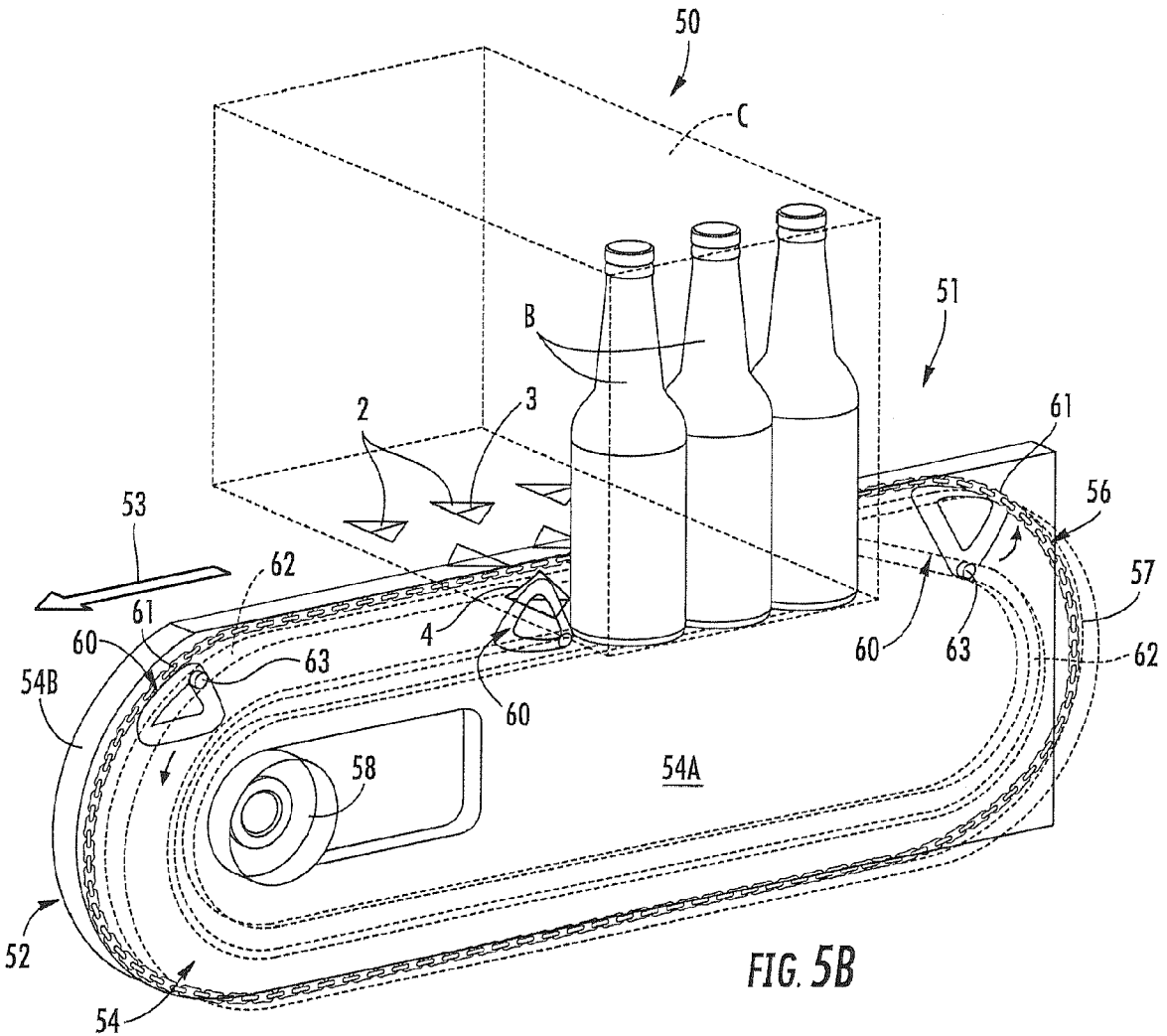
FIG. 5B is a perspective view of a cassette having a conveyor carrying selectively actuatable actuating lugs for use in the system and method for activating outside protection features as illustrated in FIG. 5A.

FIGS. 5A-5B illustrate one embodiment of a system 50 for activating the article protection features 2 of a carton C including an actuating assembly 51, which, in this embodiment, can comprise one or more cassettes 52 (only one of which is shown for clarity) that can be mounted along the path of travel 53 (FIG. 5A) of the cartons C through the packaging machine M. As noted above, the cassettes 52 generally will be mounted downstream from a loading section or area 55A of the packaging machine M, at a discharge end 55B thereof, and can be removably mounted to the frame F of the packaging machine as a change-part or similar replaceable, modular part of the packaging machine. As a result, the cassettes can be removed and replaced as needed to provide for engagement of article protection features 2 of various configurations and/or spacings for various size cartons and for ease of repair and replacement of the cassettes.

As illustrated in FIG. 5B, each cassette 51 generally can include an elongated body 54, which also can include a pair of body sections 54A and 54B, with a conveying mechanism 56 extending along a substantially elliptical path along and about the body between the body sections 54A/54B as indicated in FIG. 5B. The conveying mechanism 56 can include a chain or belt conveyor or other similar conveyor 57, typically driven by a drive mechanism 58, which drives the chain in timed movement with the movement of the loaded cartons C along their path of travel 53 (FIG. 5A) through the packaging machine M.

A series of actuating members, such as fingers, punches, fins, lugs or other elements 60 (FIG. 5B) are mounted at spaced intervals along the length of the chain or belt 57 of the conveying mechanism 56. Each of the actuating fingers generally is pivotally attached to the chain, as indicated at 61, so as to be pivotable from a lowered, non-engaging or rest position to an upwardly extended, engaging or actuating position for engaging and activating the article protection features 2 of the cartons C as the cartons move over and along the cassette(s). A cam track 62 further can be defined along the interior of the body of each cassette. Each of the actuating fingers thus can include a cam 63 that will engage and move along the cam track 62 for controlling the movement or pivoting of the actuating fingers 60 between their non-engaging and engaging positions for selectively engaging the article protection features of the cartons, as indicated in FIG. 5B.

Typically, there can be multiple cassettes arranged in series across the width of the path of travel of the cartons through the packaging machine, with there being one cassette for each row of article protection features in the cartons that are to be engaged. For example, as indicated in FIG. 5B, if there are three rows of article protection features, there can be three cassettes. The cassettes further can be arranged at staggered intervals, or can be arranged substantially parallel with the actuating fingers of the different cassettes being engaged and/or moving at different intervals (i.e., by varying the shape or configuration of the cam tracks thereof) so as to selectively engage the article protection features at varying or different intervals as needed to avoid damage or undue shifting of the articles within the cartons during engagement and activation of the article protection features, while still enabling movement of the articles within the cartons as needed for insertion of the article protection features between the articles. Alternatively, a single cassette can be provided with multiple cam tracks and multiple conveying mechanisms according to the number of rows of article protection features to be engaged, and with there further being multiple different cam tracks associated with each of the conveying mechanisms of such a single cassette to enable selective engagement of the actuating fingers thereof.

As further noted, the use of the cassettes as change-parts or modular attachments for the packaging machine enables the efficient and easy replacement of cassettes as needed to accommodate actuation of different size and/or configuration article protection features of varying or different size cartons. Thus, as the packaging machine is reconfigured for packaging of different size cartons, for example, for packaging of twelve-packs or twenty-four-packs of bottles or cans, additional or substitute cassettes can be mounted within the framework of the packaging machine in line with the path of travel 53 (FIG. 5A) of the cartons C as needed for engaging more or fewer rows of article protection features of the cartons and/or to accommodate variations in the sizes and locations of the article protection features.

FIGS. 6A-8 illustrate yet another embodiment of an actuating assembly or system 70 for activating the article protection features 2 of cartons C. As with the embodiment of the system 50 for activating article protection features of a carton shown in FIGS. 5A and 5B, the present system 70 generally can be mounted along a path of travel 71 of the cartons C through the packaging machine M, at a location upstream from the discharge or downstream end 55B of the packaging machine and after the loading area 55A of the packaging machine at which the products are loaded into the cartons, or can be made as a stand-alone system. For example, the system can be located at a position upstream from or at a position generally aligned with the area 55C of the packaging machine at which the end flaps of the cartons are folded and sealed in a closed position.

Figure 6A:
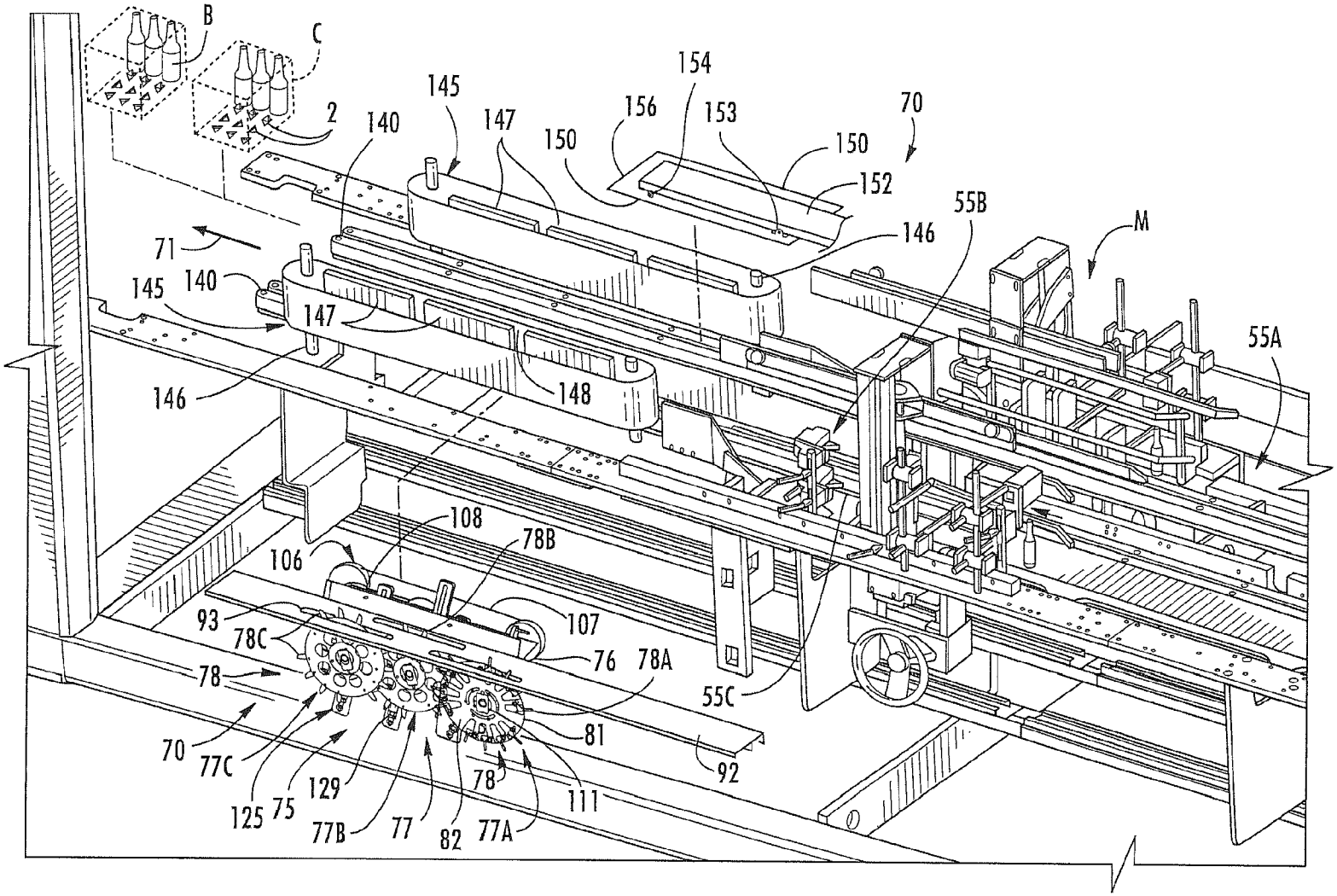
FIG. 6A is a perspective illustration of a portion of a packaging machine incorporating another example embodiment of the system and method for activating article protection features of a carton according to the principles of the present invention.
Figure 6B:
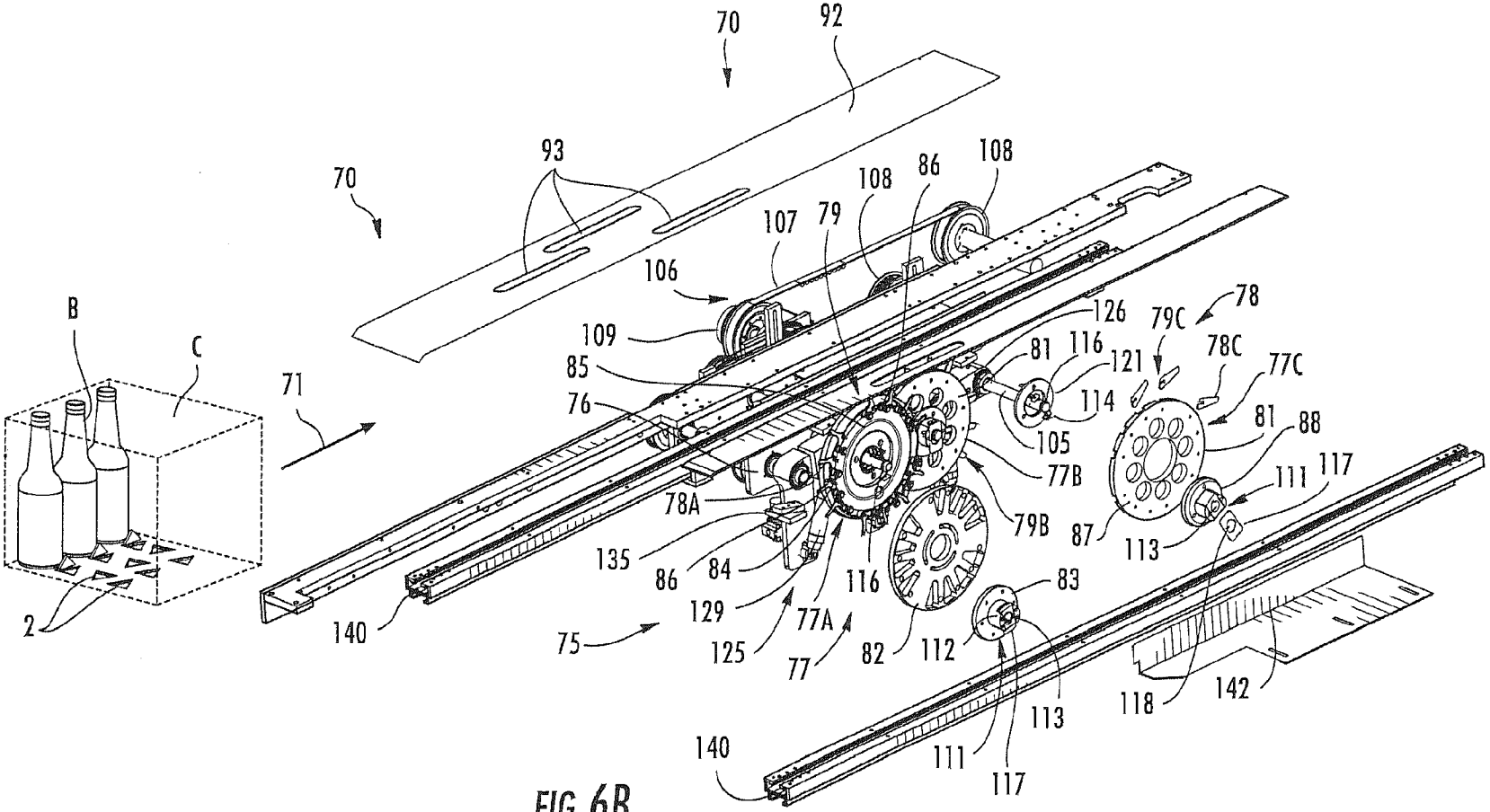
FIG. 6B is an exploded perspective view of the star wheels of the actuating assembly for engaging and activating the article protection features of a carton as illustrated in FIG. 6A.

As shown in FIGS. 6A-6B, in this embodiment 70 of the system and method for activating article protection features 2 of a carton according to the principles of the present invention, the system 70 generally will include an actuating assembly 75 that can be mountable along the path of travel 71 of the cartons through the packaging machine as a change-point. The actuating assembly 75 can include a frame 76 that supports one or more toothed star wheels or finned discs 77, or other rotating members, that will engage and activate the article protection features of the cartons as the cartons move thereover. The star wheels 77 each generally will include a series of actuating members or elements 78, which can be formed as fins, punches, articulatable lugs or actuating fingers. These actuating elements further can be arranged in groups or sets 79 spaced about the circumference or periphery 81 of each of the star wheels. For example, the actuating elements can be arranged in groups of 2-4 or more elements and while the elements can be removable and the star wheels configurable as needed, for cartons with less article protection features or smaller constructions, the additional elements generally can be left in place and a front or foremost one(s) of each group of actuating elements simply allowed to pass in front of the cartons while the remaining actuating elements engage the cartons.

As indicated in FIGS. 6A and 6B, there typically can be multiple star wheels 77, with at least one star wheel provided for each row or set of article protection features to be engaged. For example, with three rows of article protection features in the cartons, there can be three star wheels, although shorter or other configuration cartons with fewer rows of article protection features also could be run with the actuating elements 78 of at least one of the star wheels remaining out of contact with the cartons as needed. In addition, the star wheels can be positioned in a staggered arrangement so as to selectively activate the article protection features at varying or different intervals. Such a staggered engagement enables shifting or other movement of the articles within the cartons as the article protection features are inserted therebetween without binding or undue contact/engagement of the articles with the actuating elements.

Alternatively, the star wheels 77 further can be arranged in a substantially in-line or parallel arrangement as needed or desired for actuating the article protection features. In such an arrangement, the groupings or sets of the actuating fingers or punches of each of the star wheels can be located at different spacings or intervals so as to selectively engage the article protection features of the cartons at different intervals as needed or desired, although it also is possible for each of the rows of article protection features of the cartons to be engaged and activated at substantially the same time. The star wheels further can be driven in timed motion with the movement of the cartons through the packaging machine, or can be static wheels that are caused to rotate and move with the movement of the cartons thereover as their actuating fingers or punches engage and activate the article protection features of the cartons.

As generally illustrated in FIGS. 6A-7B, the star wheels 77 generally include at least one cam-operated wheel 77A and one or more fixed/stationary element wheels 77B/77C, although it will be understood by those skilled in the art that various combinations of stationary element wheels and cam-operated wheels, including use of only stationary element wheels or only cam-operated wheels, in various arrangements can be used as needed. As shown in FIG. 6B, the cam-operated wheel 77A generally includes a rotating carrier section or body portion 82 having a hub 83 approximately in the center thereof, and to which the actuating elements 78A are mounted in spaced groups 79A about the periphery 81 thereof. A cam wheel section or portion 84 is mounted to the frame 76 of the actuating assembly 75 in an opposed, spaced relationship with respect to the rotating carrier 82. The cam wheel 84 generally can be fixed against rotation and typically has a cam track 85 defined along its front surface. Cam rollers 86 attached to the actuating elements 78A generally will roll along the cam track 85, causing the actuating elements to be pivoted into engagement with the article protection features 2 of a carton C passing thereover, as indicated in FIG. 7A.

Figure 7A:
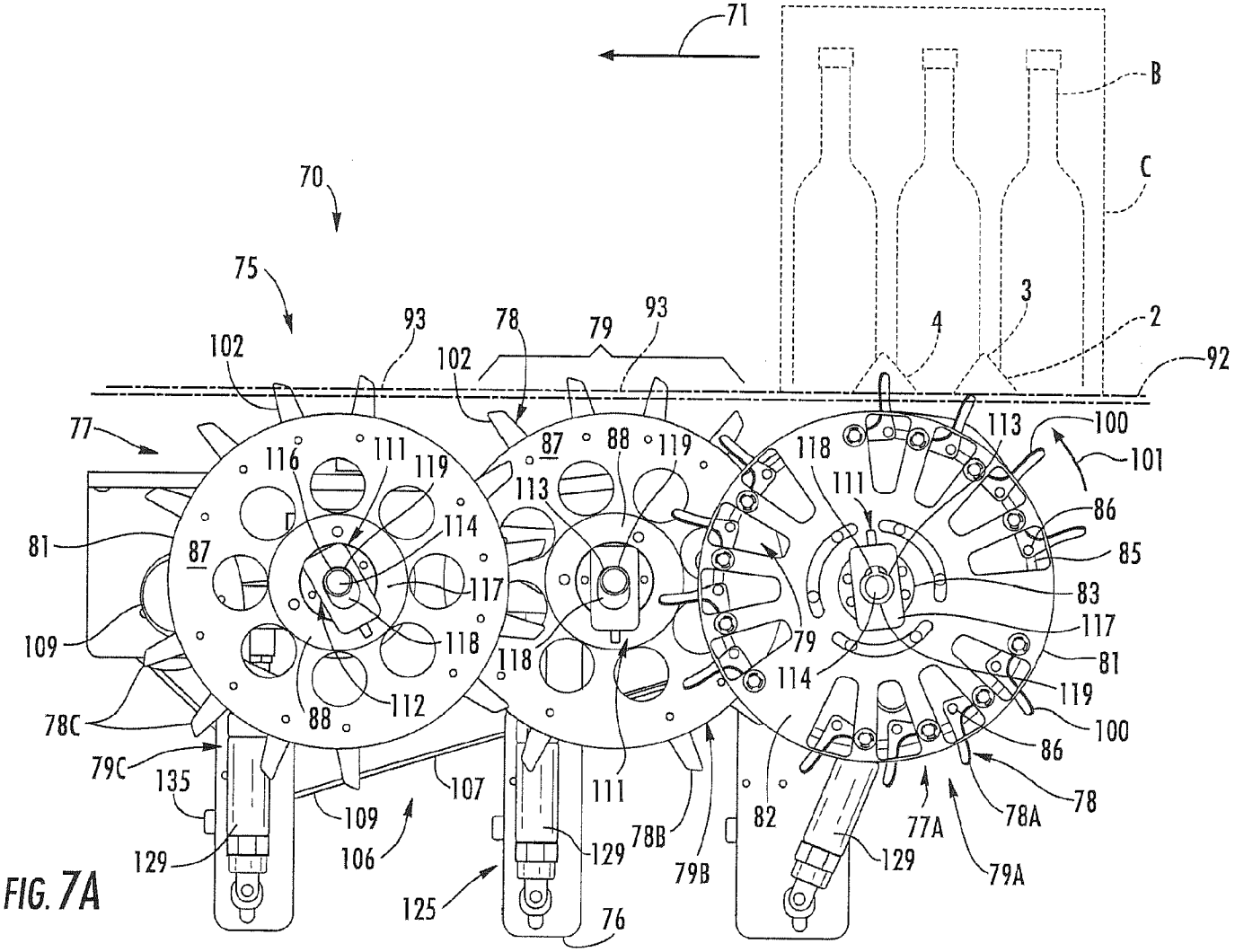
FIG. 7A is a side elevational view illustrating the star wheels of the actuating assembly of FIGS. 6A-6B.

As further illustrated in FIGS. 6B and 7A, each of the stationary element wheels 77B/77C generally will include a body 87 surrounding a central hub 88, and will have a series of fingers, punches, fins or other actuating elements 78B/78C mounted in generally fixed positions/orientations about the periphery 81 thereof by fasteners as generally illustrated in FIG. 7A. Each of the star wheels further generally is mounted in a spaced and/or staggered position with respect to the other star wheels, generally being aligned with slots 93 formed in a dead/skid plate or guide 92 over which the cartons C are moved, as indicated in FIGS. 6A-7A. As the star wheels 77A-77C are rotated, their actuating members or elements 78A-78C will be rotated upwardly through the slots 93 (FIG. 6B) formed in the dead plate 92 so as to engage the article protection features 2 aligned or associated with that slot for activating and/or urging the article protection features into positions extending within the cartons and into engagement with the articles contained therein. As further indicated in FIGS. 6B and 8, the slots 93 formed in the dead plate or guide 92 generally can be arranged at staggered intervals along the length thereof generally according to positions where the various rows of the article protection features of the cartons will be engaged at different or varying selected intervals.

Figure 7B:
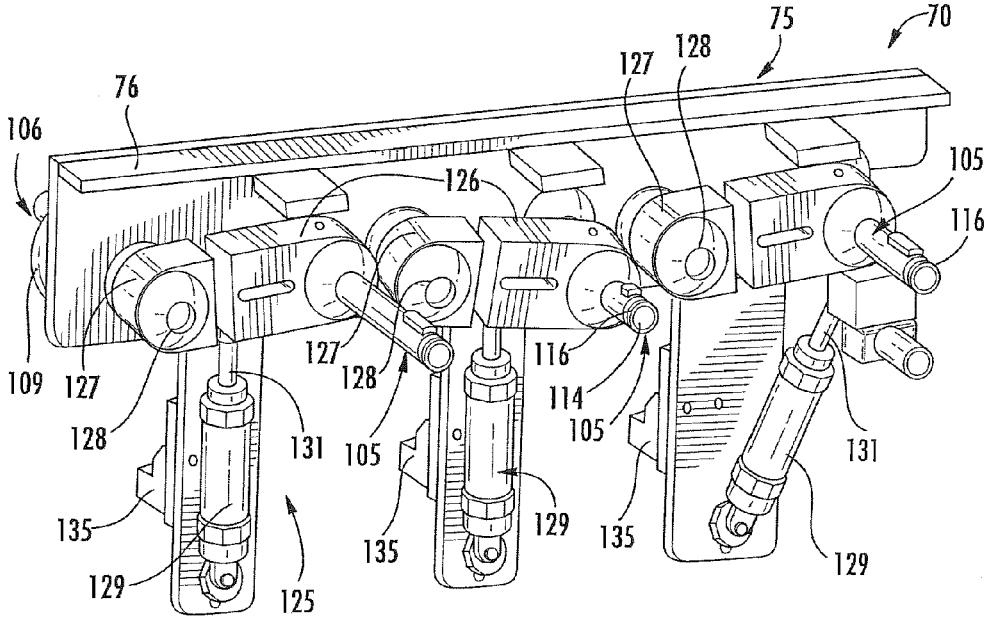
FIG. 7B is a perspective view schematically illustrating a mounting mechanism for the star wheels of FIG. 7A and overtravel protection elements therefor.
Figure 7C:
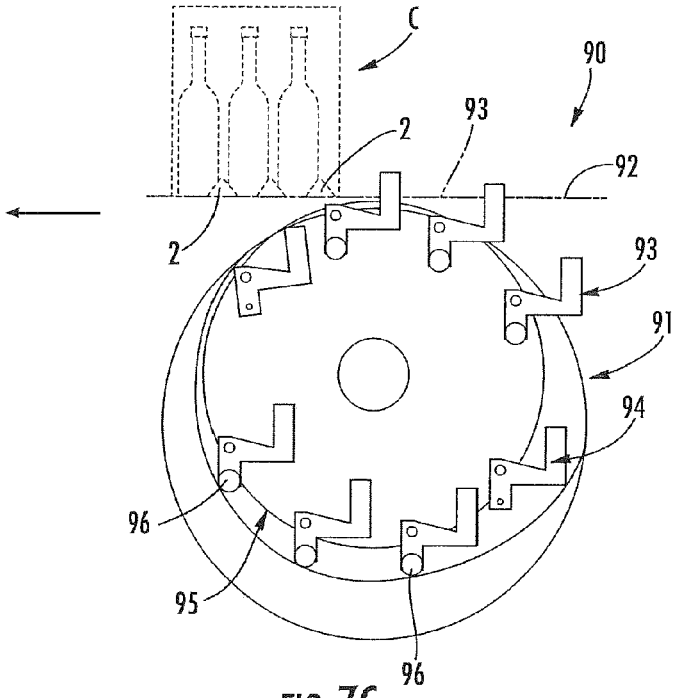
FIG. 7C is a perspective view of an alternative embodiment of the actuating assembly of FIGS. 6A-7A.

FIG. 7C further illustrates an alternative embodiment of the cam-operated wheel of the present actuating assembly for activating the article protection features of a carton. In this embodiment, the cam-operated wheel can be formed as an enlarged cylindrical drum or wheel 91 mounted below a dead/skid plate or guide 92 over which the cartons C are moved, and which can include a series of slots or grooves aligned with the article protection features of cartons passing thereover. This drum or wheel 91 can be used in place of one or all of the star wheels 77 (FIGS. 6B-7A), further generally will include a series of actuating fingers or lugs 94 (FIG. 7C) that can be mounted in substantially fixed positions about the circumference of the drum and along its length so as to engage various rows of the article protection features at varying intervals as needed or desired as the cartons pass thereover. Alternatively, the actuating fingers or lugs further can be pivotally mounted to the drum so as to be articulatable between lowered, non-engaging positions and raised, engaging positions. A cam track 95 can be provided inside the drum and can be engaged by cam rollers 96 mounted to the distal ends 97 of each of the actuating lugs or fingers 94. As the cam rollers move along the cam track, the actuating fingers can be moved or pivoted between their non-engaging and engaging positions for activating the article protection features as the drum is rotated beneath the cartons passing over the dead plate or guide thereabove.

As further generally indicated in FIG. 7A, the pivoting actuating elements 78A of the cam-operated wheel 77A can be formed with a different construction or configuration from the fixed or stationary mounted elements 78B/78C of the stationary element wheels 77B/77C as needed to facilitate the engagement of these actuating elements of the cam-operated wheel with the article protection features of the article protection features of the cartons as such actuating elements typically can be the first actuating elements to engage the cartons. For example, as illustrated in FIG. 7A, the actuating elements 78A of the cam-operated wheel 77A can have a more slender configuration, with a tapered and/or curved front or forward engaging edge or surface 100 to facilitate their entry into the cartons C as they are pivoted upwardly as indicated by arrow 101. As also indicated in FIG. 7A, the stationary or fixed elements 78B/78C generally can have a substantially straight or front or forward engaging surface or edge 102. The forward or engaging edges of each of the actuating elements 78A-78C further can be beveled or rounded so as to facilitate engagement and disengagement of the actuating elements from the article protection features once the article protection features have been activated and/or inserted into the cartons.

As further shown in FIGS. 7A and 7B, each of the star wheels 77 generally is releasably attached to a drive shaft 105 that is driven by a drive system 106. As FIG. 8 generally illustrates, the drive system 106 can include a series of belts 107 and/or gears 108 coupled to each of the drive shafts and generally being driven by a motor or other, similar drive mechanism 109. The drive belts 107 thus link each of the drive shafts for driving the star wheels 77 in a timed relationship. Alternatively, one or more servomotors can be used for driving each of the drive shafts and thus driving each of the star wheels as needed.

As FIGS. 6B-7A illustrate, the star wheels further can be releasably mounted on their drive shafts by releasable couplings 111, which generally are mounted in the hub portions 83/88 of each of the star wheels 77 for locking the star wheels in position on their drive shafts. Each of the couplings will include a body portion 112 having a central opening 113 defined therein and through which a distal end 114 of its associated drive shaft 105 is received. Each drive shaft further generally can include a slot or recess 116 formed adjacent its distal end 114, as indicated in FIG. 7B. A sliding lock plate 117 generally will be received on the body 112 of each coupling, and will include a corresponding central opening 118 having a circumferential edge 119 defined thereabout. Each lockplate further generally will be biased toward a closed or engaging position whereby the peripheral edge 119 of its central opening 118 will be received within and engage the recess or slot 116 formed in the distal end of a drive shaft 105 to which it is mounted. As further shown in FIG. 6B, each of the stationary or fixed element wheels 77B/77C also can include a rear hub or bearing plate 121 that can be fixed to its drive shaft so as to provide a bearing surface against which the fixed element wheels are engaged and held as they are rotated by their drive shafts.

As additionally illustrated in FIG. 7B, the actuating assembly 75 of the present embodiment further can be provided with an overload protection system 125 by which the star wheels individually, or as a unit, can be moved away from engagement with the cartons upon one or more of the actuating elements thereof meeting with a preprogrammed level of back pressure or resistance. For example, as the actuating elements of the star wheels engage the article protection features of a carton, if a bottle has shifted or fallen and thus blocks the entrance of the actuating elements therein, or if there is some other obstruction that is met, the star wheel along which such actuating element is mounted can be urged downwardly, as opposed to forcing its way into the carton, so as to avoid potentially breaking or damaging the articles within the carton.

In one example embodiment of such an overload protection system 125 shown in FIG. 7B, the drive shafts 105 for the star wheels can be mounted to bearing members or supports 126 that are pivotally attached to the frame 76 of the actuating assembly 75 by bearings 127 mounted on pivot rods or pins 128. Each of the bearing members 126 supporting the drive shafts of the star wheels further will be connected or coupled to an overload cylinder 129, which can include pneumatic or hydraulic cylinders, and/or other, similar cushioning or biasing mechanisms, including various spring bias mechanisms or the like. For example, as indicated in FIG. 7B, the overload cylinders 129 can include cylinder rods 131 that are connected directly to the bearing members 126 for the drive shafts. These overload cylinders can be set at a desired pressure or force so as to maintain the star wheels in their raised, operative positions at a desired elevation during operation of the system 70. Upon an actuating element of one of the star wheels hitting one of the articles or otherwise meeting with a force or back pressure sufficient to overcome the upward biasing force of the overload cylinder therefor, the bearing or support for the star wheel can be lowered, as the cylinder rod is retracted into its overload cylinder until the carton has passed thereover.

As additionally shown in FIG. 7B, a series of sensors 135 also can be provided along the frame 76, in positions adjacent to and in communication with the overload cylinders 129. The sensors 135 can include various types of contact or proximity sensors, or other sensors adapted to detect when the overload cylinders had been engaged and/or the star wheels mounted thereto into a lowered, non-engaging position. The sensors accordingly can signal an operator to advise that the overload protection system has been engaged, indicating to an operator that a carton with a fault condition has been detected. The operator can then remove the carton from the packaging line, either manually or by an automatic reject system being engaged. Alternatively, upon engagement of the overload protection system, the entire packaging machine can be shut down until the detected fault has been remedied and/or the carton removed from the packaging line.

As further illustrated in FIGS. 6A and 6B, the cartons C generally are conveyed along their path of travel 71 through the actuating assembly 75 of the embodiment of the system 70 by spaced conveyors 140, which are typically positioned on opposite sides of the path of travel of the cartons. The conveyors 140 generally can include chain or belt conveyors, typically having a series of conveying lugs or pushers mounted thereon. The conveyors further can comprise extensions of the carton conveyors of the packaging machine M itself or can be separate conveyors that receive the closed cartons from the loading area 55A of the packaging machine for movement of the cartons through the actuating assembly 75.

As additionally shown in FIGS. 6A and 6B, one or more side guide plates 142 can be mounted along the actuating assembly adjacent the upstream end thereof. Such side guide plates can be mounted in a fixed position on one or both sides of the path of travel 71 of the cartons C. The side guide plates 142 will engage and align the cartons in a proper alignment with the rows of article protection features of the cartons being adjusted and/or aligned with the slotted openings of the dead plate or guide 92 through which the actuating elements of each of the star wheels will project.

Still further, a pair of side guide belts 145 (FIG. 6A) generally are mounted along the path of travel 71 of the cartons C, adjacent the points or areas along which the star wheels engage the cartons. Each of the side guide belts generally includes an elongated, elliptically extending belt that is extended about a pair of drive shafts or wheels 146, at least one of which can be driven for driving the side belts as needed to help convey the cartons C through the actuating assembly 75. In addition, a series of bearing plates 147 generally will be mounted in spaced series adjacent an interior surface 148 of each of the side belts. Each of these bearing plates generally will be biased inwardly such as by springs or other biasing mechanisms, toward the cartons so as to maintain the side belts in contact with the side surfaces of the cartons as they pass therebetween. The biased engagement of these bearing plates enables the belts and bearing plates to shift or move laterally as needed to allow for some desired expansion or lateral movement of the cartons and side portions thereof as the articles within the cartons are shifted or moved upon engagement and activation of the article protection features therein to thus maintain the cartons in a desired alignment for continued engagement and activation of the article protection features by the actuating elements of the star wheels, with the potential for damage or breakage of such articles being minimized.

As FIG. 6A also shows, a spring biased top bearing plate 150 generally can be mounted above the area 151 at which the articles are being engaged by the actuating elements of the star wheels of the actuating assembly 75. The top bearing plate generally can include an elongated plate having a substantially flat, smooth lower surface 151 along which the upper surfaces of the cartons can pass, and typically will be made from a substantially reduced friction material such as a polished steel, aluminum or other metal, or various reduced friction composite or synthetic materials. The top bearing plate generally will be pivotally mounted to a support 152 adjacent a rear or distal end 153 thereof, and further can include at least one biasing element 154 such as a spring or other, similar element adjacent its forward or proximal end 156 for urging or biasing the top bearing plate toward the top of the cartons. The top bearing plate thus provides a surface against which the cartons can be urged and/or held as the actuating elements engage and urge the article protection features of the cartons inwardly into the interior of the cartons and between the articles contained therein.

In operation, the actuating assembly 75 of the present embodiment of the system 70 (FIG. 6A) for actuating the article protection features 2 of cartons C can be provided with a series of star wheels 77 having a desired number of actuating elements such as fins, punches, fingers, lugs, etc. mounted in spaced groups or series thereabout. As the cartons are received from the loading area 55A of the packaging machine M, the lateral position of the cartons generally can be adjusted so that the cartons are properly aligned with the path of travel 71 through the actuating assembly 75. Thereafter, as the cartons are moved through the actuating assembly, the sides of the cartons will be engaged by side guide belts 145, which exert a bearing force against the sides of the cartons so as to maintain the lateral position of the cartons as they move along the guide plate 92.

As the cartons thereafter move along the guide plate, a first group of article protection features 2 generally will be engaged by a series of pivoting actuating elements or members 78A of a cam-operated wheel 77A. Typically, as indicated in FIG. 6A, a middle or central row of article protection features 2 generally will be engaged by the actuating elements of the cam-operated wheel in the present example embodiment. As the rotating carrier portion 82 of the cam-operated wheel rotates its actuating elements 78A about the cam wheel 84, the actuating elements are pivoted upwardly and into engagement with the article protection features 2 as shown by arrow 101 in FIG. 7A, so as to cause the insertion and/or expansion of such article protection features into the carton and into engagement with adjacent articles. Thereafter, the article protection features 2 of the remaining rows of article protection features of the carton will be selectively engaged at varying or different intervals by the downstream stationary or fixed element wheels 77B and 77C. As noted, each of the article protection features generally can be engaged at staggered or spaced intervals so as to enable shifting or other movement of the articles within the cartons as needed as the article protection features are inserted therebetween, so as to avoid or minimize potential binding or damage to the articles by the actuating elements being moved into and out of engagement with the article protection features. Thereafter, once the article protection features of the cartons have been fully engaged, the cartons can be removed for storage and/or transport.

Alternatively, if a bottle or other obstruction is engaged by one of the actuating elements of one of the star wheels, thus causing the overload protection system to be engaged, the star wheels can be moved, either as a unit or individually, out of engagement with the cartons passing thereover to prevent damage to the articles within the cartons. A signal also can be sent to alert an operator or machine control of the existence of a fault condition within a carton, which can be monitored and, based upon its position or a timed length of travel, can be either manually or automatically sent to a reject line. Alternatively, the entire packaging machine can be shut down either in response to a single or in response to multiple engagements or actuations of the overload protection system.

Figure 9:
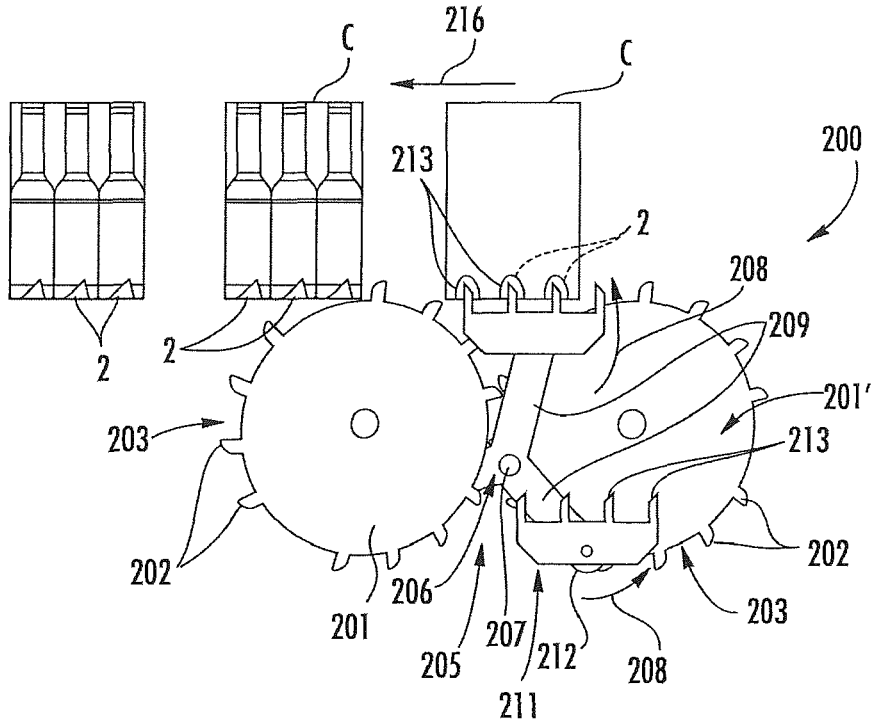
FIG. 9 is a schematic illustration of still a further embodiment of a system and method for activating article protection features of a carton according to the principles of the present invention.

FIG. 9 illustrates still another additional embodiment of a system 200 for activating article protection features 2 of a carton C according to the principles of the present invention. In this embodiment, the system 200 can comprise one or more static or star wheels 201/201', which can be mounted in a spaced, staggered arrangement as indicated in FIG. 9. Each of the star wheels can be configured as discussed above with regard to FIGS. 6A-6B, including a series of actuating elements or members 202 such as fingers, lugs, punches or fins arranged in spaced groups or sets 203 thereabout. In addition, a rotatable engagement mechanism 205 also can be utilized in conjunction with one or more of the star wheels 201/201', or alternatively, in place of one or more of the star wheels. Such star wheels 201/201' are generally shown as having fixed sets or groups of actuating elements 102; however, it also will be understood that alternative configuration wheels, including wheels with a series of movable or cam-operated actuating elements also can be used. For example, multiple ones of the rotatable engagement mechanisms 205 can be provided for each row of article protection features of the cartons to be engaged thereby, or a single rotatable engagement mechanism can be provided adjacent the star wheels, for example, between upstream and downstream star wheels 201/201' as illustrated in FIG. 9.

As shown in FIG. 9, the rotatable engagement mechanism 205 generally will include a body 206 rotatably mounted to a driveshaft 207 and can be rotated by a motor or similar drive mechanism (not shown), or alternatively, can be caused to rotate by engagement of the cartons passing thereover and imparting a rotary movement to the body of the engagement mechanism as indicated by arrows 208. The body 206 generally can include one or more arms 209 or extension portions, each having an engagement tool or member 211 attached at a distal end 212 thereof. Each of the engagement members or tools 211 further typically will include a series of upstanding actuating members or elements such as fingers, punches, tabs or lugs 213 arranged at spaced intervals along an upper surface 214 thereof. These actuating fingers or lugs 213 can be mounted in fixed or variable arrangement and/or configurations along or across their engagement tools, and also can be selectively activated, such as by a solenoid or other drive mechanism, to further control their engagement with the article protection features of the cartons.

The engagement tools generally are arranged at varying intervals about the body of the rotatable engagement mechanism as shown in FIG. 9, and can be rotated into engagement with the article protection features of the cartons at substantially the same time, or at varying intervals as needed or desired. In addition, while a series of four actuating fingers or lugs 213 are shown, as are three arms 209 for the body 206 of the rotating engagement mechanism 205, it will be understood by those skilled in the art that additional or fewer actuating fingers also can be provided for each of the engagement tools, and that more or fewer engagement tools also can be provided as part of the rotatable engagement mechanism, as needed to engage and activate article protection features of various configurations and arrangements and for various size cartons.

Figure 8:
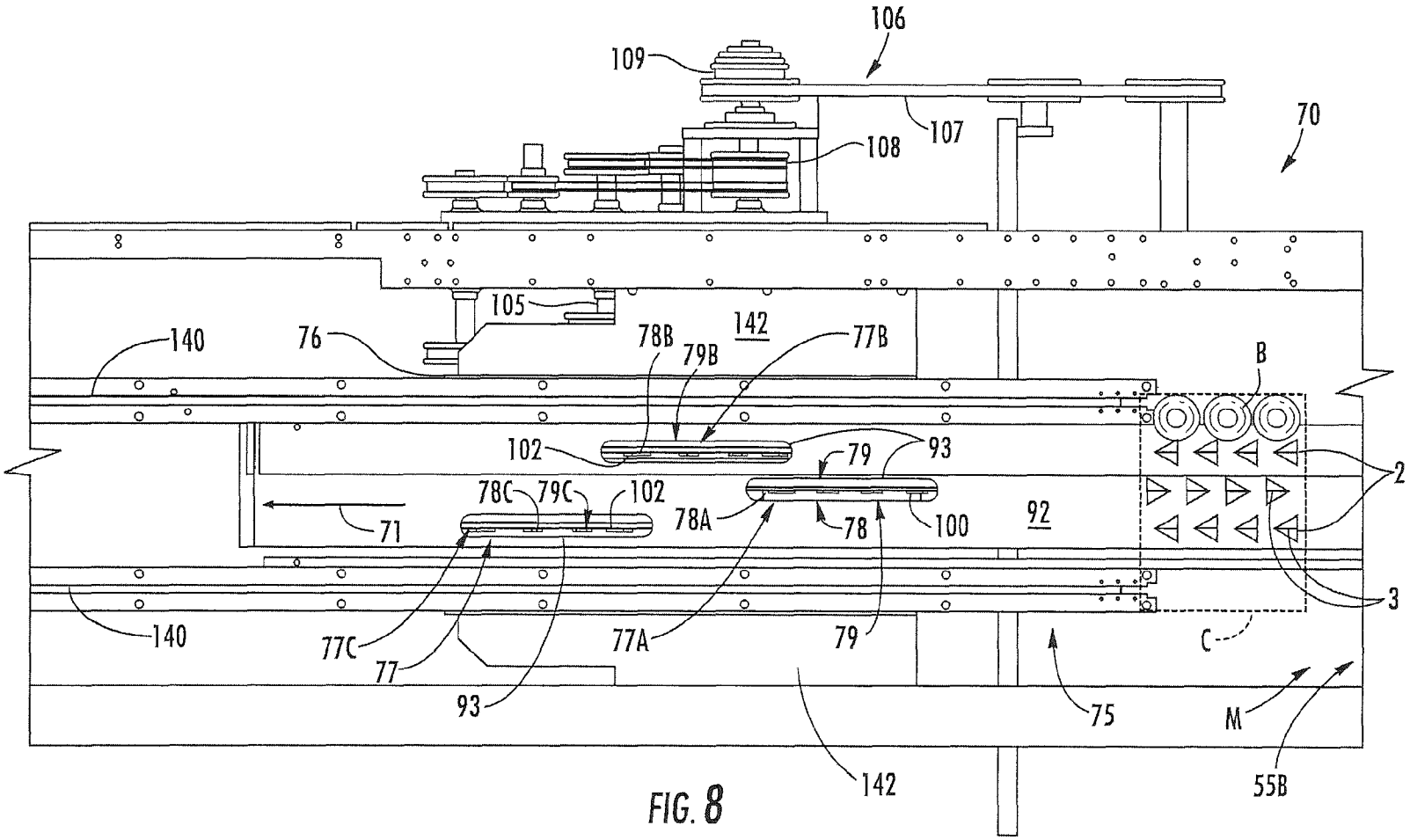
FIG. 8 is a plan view illustrating the dead plate and slotted openings thereof for passage of the actuating elements of the star wheels of FIGS. 6A-7B.

As the engagement mechanism 205 is rotated so as to move one of its engagement tools or members 211 into engagement with a row of article protection features 2 of a carton C moving along its path of travel 216 and passing over the engagement mechanism, the actuating fingers or lugs 213 of the engagement tool will be raised into engagement with the article protection features of the carton, as shown in FIG. 9. As the actuating fingers or lugs engage and are moved upwardly into the carton, the article protection features of the carton are activated, causing them to be moved to an engaged, operative position. As indicated in FIG. 8, the spacing and orientation/alignment of the actuating fingers along the engagement tools further can be provided so that selected ones or all of the article protection features of a single row of protection features of the carton can be substantially simultaneously engaged, or can be configured so as to engage the carton sequentially as needed to minimize shifting or movement of the articles in the cartons. Additionally, the spacing and/or configuration of the actuating fingers can be selected such that cartons of reduced sizes and/or cartons having a reduced number of article protection features therein will be engaged only by a number of actuating fingers of each of the engagement tools corresponding to the number of article protection features of the carton, with any additional actuating fingers or lugs maintained at a spacing apart from and out of engagement with the carton walls, as also shown in FIG. 9.

The foregoing description of the invention illustrates and describes various embodiments thereof. As various changes can be made to the above construction, without departing from the spirit and scope of the present invention, it is intended that all matter contained in the above description or shown in the accompanying drawings shall be interpreted as illustrative and not in a limiting sense. Furthermore, the scope of the present disclosure covers various modifications, combinations, alterations, etc., of the above-described embodiments. Additionally, while the present disclosure shows and describes selected embodiments of the present invention, it will be understood that various other combinations, modifications and environments are within the scope of the disclosure as expressed herein, commensurate with the above teachings, and/or within the skill or knowledge of the relevant art. Accordingly, it will be understood that certain features and characteristics of each embodiment may be selectively interchanged and applied to other illustrated and non-illustrated embodiments of the present invention.

Accordingly, it will be readily understood by those persons skilled in the art that, in view of the above detailed description of the invention, the present invention is susceptible to broad utility and application. Many adaptations of the present invention other than those herein described, as well as many variations, modifications, and equivalent arrangements will be apparent from or reasonably suggested by the present invention and the above detailed description thereof, without departing from the substance or scope of the present invention.

What is claimed is:

1. A system for moving a first article protection feature into a carton loaded with a plurality of articles, the system comprising:

a loading section for loading the plurality of articles into the carton to form a loaded carton;

a conveyor for moving the loaded carton along a path of travel; and an actuating assembly positioned along the path of travel of the loaded carton, the actuating assembly including a first actuating member oriented to move the first article protection feature into the carton so that the first article protection feature engages a first article and a second article of the plurality of articles and the first article protection feature moves the first article;

wherein the system further comprises an overload protection mechanism that disengages the first actuating member from engagement with the first article protection feature upon encountering a back pressure from moving the first article protection feature into the loaded carton.

2. The system of claim 1, wherein the actuating assembly further comprises a second actuating member oriented to move a second article protection feature into the loaded carton so that the second article protection feature engages a third article and a fourth article of the plurality of articles and the second article protection feature moves the third article.

3. The system of claim 2, wherein the first article protection feature is oriented to be moved into the loaded carton in a first direction and the second article protection feature is oriented to be moved into the loaded carton in a second direction; and wherein the first direction is opposite the second direction.

4. The system of claim 2, wherein the second article protection feature is moved into the loaded carton after the first article protection feature is moved into the loaded carton.

5. The system of claim 4, wherein the first actuating member is at a first position along the path of travel and the second actuating member is at a second position along the path of travel, and wherein the second position is spaced laterally from the first position, and wherein the second position is spaced downstream from the first position along the path of travel.

6. The system of claim 4, wherein the first article protection feature is oriented to be moved into the loaded carton in a first direction and the second article protection feature is oriented to be moved into the loaded carton in a second direction; and wherein the first direction is opposite the second direction.

7. The system of claim 2, wherein the first actuating member is at a first position along the path of travel and the second actuating member is at a second position along the path of travel, and wherein the second position is spaced laterally from the first position, and wherein the second position is spaced downstream from the first position along the path of travel.

8. The system of claim 7, wherein the first article protection feature is oriented to be moved into the loaded carton in a first direction and the second article protection feature is oriented to be moved into the loaded carton in a second direction; and wherein the first direction is opposite the second direction.

9. A system for moving a first article protection feature into a carton loaded with a plurality of articles, the system comprising:

a loading section for loading the plurality of articles into the carton and closing the carton;

a conveyor for moving the carton along a path of travel; and an actuating assembly positioned along the path of travel of the carton, the actuating assembly being downstream of the loading section, the actuating assembly including a first actuating member oriented to move the first article protection feature into the carton so that the first article protection feature engages a first article and a second article of the plurality of articles and the first article protection feature moves the first article;

wherein the system further comprises an overload protection mechanism that disengages the first actuating member from engagement with the first article protection feature upon encountering a back pressure from moving the first article protection feature into the carton.

10. The system of claim 9, wherein the actuating assembly further comprises a second actuating member oriented to move a second article protection feature into the carton so that the second article protection feature engages a third article and a fourth article of the plurality of articles and the second article protection feature moves the third article.

11. The system of claim 10, wherein the first article protection feature is oriented to be moved into the carton in a first direction and the second article protection feature is oriented to be moved into the carton in a second direction; and wherein the first direction is opposite the second direction.

12. The system of claim 10, wherein the second article protection feature is moved into the carton after the first article protection feature is moved into the carton.

13. The system of claim 12, wherein the first actuating member is at a first position along the path of travel and the second actuating member is at a second position along the path of travel, and wherein the second position is spaced laterally from the first position, and wherein the second position is spaced downstream from the first position along the path of travel.

14. The system of claim 12, wherein the first article protection feature is oriented to be moved into the carton in a first direction and the second article protection feature is oriented to be moved into the carton in a second direction; and wherein the first direction is opposite the second direction.

15. The system of claim 10, wherein the first actuating member is at a first position along the path of travel and the second actuating member is at a second position along the path of travel, and wherein the second position is spaced laterally from the first position, and wherein the second position is spaced downstream from the first position along the path of travel.

16. The system of claim 15, wherein the first article protection feature is oriented to be moved into the carton in a first direction and the second article protection feature is oriented to be moved into the carton in a second direction; and wherein the first direction is opposite the second direction.

17. A system for moving a first article protection feature and a second article protection feature into a carton loaded with a plurality of articles, the system comprising:

a loading section for loading the plurality of articles into the carton to form a loaded carton;

a conveyor for moving the loaded carton along a path of travel; and an actuating assembly positioned along the path of travel of the loaded carton, the actuating assembly including a first actuating member and a second actuating member, the first actuating member being at a first position along the path of travel and the second actuating member being at a second position along the path of travel, the second position being spaced laterally from the first position, the first actuating member being oriented to move the first article protection feature into the loaded carton so that the first article protection feature engages a first article and a second article and the first article protection feature moves the first article;

wherein the system further comprises an overload protection mechanism that disengages the first actuating member from engagement with the first article protection feature upon encountering a back pressure from moving the first article protection feature into the loaded carton.

18. The system of claim 17, wherein the actuating assembly further comprises:

at least a first wheel, the first actuating member and the second actuating member being on the first wheel, wherein the overload protection mechanism comprises a first cylinder biasing the first wheel toward an operative position with the first actuating member in engagement with the first article protection feature while enabling the first wheel to move out of engagement with the first article protection feature to a nonoperative position.

19. The system of claim 18, wherein the second article protection feature is moved into the loaded carton after the first article protection feature is moved into the loaded carton.

20. The system of claim 17, wherein the second actuating member is oriented to move the second article protection feature into the loaded carton so that the second article protection feature engages a third article and a fourth article of the plurality of articles and the second article protection feature moves the third article.

21. The system of claim 20, wherein the first article protection feature is oriented to be moved into the loaded carton in a first direction and the second article protection feature is oriented to be moved into the loaded carton in a second direction; and wherein the first direction is opposite the second direction.

22. The system of claim 20, wherein the second article protection feature is moved into the loaded carton after the first article protection feature is moved into the loaded carton.

23. The system of claim 22, wherein the first article protection feature is oriented to be moved into the loaded carton in a first direction and the second article protection feature is oriented to be moved into the loaded carton in a second direction; and wherein the first direction is opposite the second direction.

24. The system of claim 17, wherein the second actuating member is oriented to move the second article protection feature into the loaded carton so that the second article protection feature engages a third article and a fourth article of the plurality of articles and the second article protection feature moves the third article and the fourth article, and wherein the second position is spaced downstream from the first position along the path of travel.

25. The system of claim 24, wherein the first article protection feature is oriented to be moved into the loaded carton in a first direction and the second article protection feature is oriented to be moved into the loaded carton in a second direction; and wherein the first direction is opposite the second direction.

26. The system of claim 17, wherein the first article protection feature is oriented to be moved into the loaded carton in a first direction and the second article protection feature is oriented to be moved into the loaded carton in a second direction; and wherein the first direction is opposite the second direction.

27. The system of claim 26, wherein the second article protection feature is moved into the loaded carton after the first article protection feature is moved into the loaded carton.

28. The system of claim 17, wherein the second article protection feature is moved into the loaded carton after the first article protection feature is moved into the loaded carton.

29. A system for moving a first article protection feature and a second article protection feature into a carton loaded with a plurality of articles, the system comprising:

a loading section for loading the plurality of articles into the carton and closing the carton;

a conveyor for moving the carton along a path of travel; and an actuating assembly positioned along the path of travel of the carton, the actuating assembly being downstream of the loading section, the actuating assembly including a first actuating member and a second actuating member, the first actuating member being at a first position along the path of travel and the second actuating member being at a second position along the path of travel, the second position being spaced laterally from the first position, the first actuating member being oriented to move the first article protection feature into the carton so that the first article protection feature engages a first article and a second article of the plurality of articles and the first article protection feature moves the first article;

wherein the system further comprises an overload protection mechanism that disengages the first actuating member from engagement with the first article protection feature upon encountering a back pressure from moving the first article protection feature into the carton.

30. The system of claim 29 wherein the carton is formed of paperboard having a thickness and, with the first article protection feature engaged with the first article and the second article, the first article is separated from the second article by at least twice the thickness of the paperboard.

31. The system of claim 29, wherein the second actuating member is oriented to move the second article protection feature into the carton so that the second article protection feature engages a third article and a fourth article of the plurality of articles and the second article protection feature moves the third article.

32. The system of claim 31, wherein the first article protection feature is oriented to be moved into the carton in a first direction and the second article protection feature is oriented to be moved into the carton in a second direction; and wherein the first direction is opposite the second direction.

33. The system of claim 31, wherein the second article protection feature is moved into the carton after the first article protection feature is moved into the carton.

34. The system of claim 33, wherein the first article protection feature is oriented to be moved into the loaded carton in a first direction and the second article protection feature is oriented to be moved into the loaded carton in a second direction; and wherein the first direction is opposite the second direction.

35. The system of claim 29, wherein the second actuating member is oriented to move the second article protection feature into the carton so that the second article protection feature engages a third article and a fourth article of the plurality of articles and the second article protection feature moves the third article and the fourth article, and wherein the second position is spaced downstream from the first position along the path of travel.

36. The system of claim 29, wherein the first article protection feature is oriented to be moved into the carton in a first direction and the second article protection feature is oriented to be moved into the carton in a second direction; and wherein the first direction is opposite the second direction.

37. The system of claim 29, wherein the second article protection feature is moved into the carton after the first article protection feature is moved into the carton.

38. A system for moving a first article protection feature into a carton loaded with a plurality of articles, the system comprising:

a loading section for loading the plurality of articles into the carton to form a loaded carton;

a conveyor for moving the loaded carton along a path of travel; and an actuating assembly positioned along the path of travel of the loaded carton, the actuating assembly including a first actuating member oriented to move the first article protection feature into the carton so that the first article protection feature engages a first article and a second article of the plurality of articles and the first article protection feature moves the first article;

wherein the actuating assembly further comprises a second actuating member oriented to move a second article protection feature into the loaded carton so that the second article protection feature engages a third article and a fourth article of the plurality of articles and the second article protection feature moves the third article;

wherein the second article protection feature is moved into the loaded carton after the first article protection feature is moved into the loaded carton;

wherein the first actuating member is at a first position along the path of travel and the second actuating member is at a second position along the path of travel, and wherein the second position is spaced laterally from the first position, and wherein the second position is spaced downstream from the first position along the path of travel;

wherein the first article protection feature is oriented to be moved into the loaded carton in a first direction and the second article protection feature is oriented to be moved into the loaded carton in a second direction; and wherein the first direction is opposite the second direction;

wherein the system further comprises an overload protection mechanism that disengages the first actuating member from engagement with the first article protection feature upon encountering a back pressure from moving the first article protection feature into the loaded carton.

39. A system for moving a first article protection feature into a carton loaded with a plurality of articles, the system comprising:

a loading section for loading the plurality of articles into the carton and closing the carton;

a conveyor for moving the carton along a path of travel; and an actuating assembly positioned along the path of travel of the carton, the actuating assembly being downstream of the loading section, the actuating assembly including a first actuating member oriented to move the first article protection feature into the carton so that the first article protection feature engages a first article and a second article of the plurality of articles and the first article protection feature moves the first article;

wherein the actuating assembly further comprises a second actuating member oriented to move a second article protection feature into the carton so that the second article protection feature engages a third article and a fourth article of the plurality of articles and the second article protection feature moves the third article;

wherein the second article protection feature is moved into the carton after the first article protection feature is moved into the carton;

wherein the first actuating member is at a first position along the path of travel and the second actuating member is at a second position along the path of travel, and wherein the second position is spaced laterally from the first position, and wherein the second position is spaced downstream from the first position along the path of travel;

wherein the first article protection feature is oriented to be moved into the carton in a first direction and the second article protection feature is oriented to be moved into the carton in a second direction; and wherein the first direction is opposite the second direction;

wherein the system further comprises an overload protection mechanism that disengages the first actuating member from engagement with the first article protection feature upon encountering a back pressure from moving the first article protection feature into the carton.

* * * * *